US012110683B2

(12) United States Patent
Lim

(10) Patent No.: US 12,110,683 B2
(45) Date of Patent: Oct. 8, 2024

(54) BUILDING SYSTEM

(71) Applicant: NXT Building System Pty. Ltd., Canning Vale (AU)

(72) Inventor: Matakii Lim, Canning Vale (AU)

(73) Assignee: NXT Building System Pty. Ltd., Canning Vale (AU)

( * ) Notice: Subject to any disclaimer, the term of this patent is extended or adjusted under 35 U.S.C. 154(b) by 1 day.

(21) Appl. No.: 16/491,546

(22) PCT Filed: Mar. 3, 2018

(86) PCT No.: PCT/AU2018/050194

§ 371 (c)(1),
(2) Date: Sep. 5, 2019

(87) PCT Pub. No.: WO2018/161110

PCT Pub. Date: Sep. 13, 2018

(65) Prior Publication Data

US 2021/0131100 A1 May 6, 2021

(30) Foreign Application Priority Data

Mar. 7, 2017 (AU) ..... 2017900792

(51) Int. Cl.
*E04B 5/32* (2006.01)
*E04B 5/36* (2006.01)
*E04C 5/06* (2006.01)

(52) U.S. Cl.
CPC ..... *E04B 5/328* (2013.01); *E04B 5/36* (2013.01); *E04C 5/064* (2013.01);
(Continued)

(58) Field of Classification Search
CPC . E04B 5/328; E04B 5/43; E04B 5/265; E04B 5/326; E04B 5/04; E04B 5/023; E04B 5/02; E04B 9/0485
See application file for complete search history.

(56) References Cited

U.S. PATENT DOCUMENTS 1,313,500 A * 8/1919 Nies et al. ..... E04B 5/326
52/125.3
1,672,886 A * 6/1928 Gross ..... E04B 5/08
138/115

(Continued)

FOREIGN PATENT DOCUMENTS

BE 1019066 A3 * 2/2012 ..... E04B 5/328
CA 2968184 A1 * 11/2018 ..... E04B 5/023

(Continued)

OTHER PUBLICATIONS

Translation for JP 2005133466 A. (Year: 2005).*

(Continued)

*Primary Examiner* — Jessica L Laux
(74) *Attorney, Agent, or Firm* — Blanchard Horton PLLC

(57) ABSTRACT

The present invention relates to a prefabricated deck unit for a building system, the deck unit including: a reinforcing framework encased in a composite material, the reinforcing framework comprising: a first metal mesh unit, a plurality of interspaced spheroidal void formers attached to or in intimate contact with the first mesh unit, and a second mesh unit resting upon, or attached to, the spheroidal void formers, wherein the framework defines at least one terminal channel on at least one end of the deck unit, the terminal channel being shaped and dimensioned to snugly receive an elongate connecting rod for connecting the deck unit to a further structural element of the building system.

14 Claims, 29 Drawing Sheets

(52) U.S. Cl.
CPC ... *E04B 2005/322* (2013.01); *E04B 2005/324* (2013.01); *E04C 5/0609* (2013.01)

(56) References Cited

U.S. PATENT DOCUMENTS

| | | | | | |
|---|---|---|---|---|---|
| 2,970,388 | A | * | 2/1961 | Yonkers | G09B 23/26 434/277 |
| 6,065,263 | A | | 5/2000 | Taguchi | |
| 9,410,316 | B2 | * | 8/2016 | Reigstad | E04B 5/023 |
| 9,797,139 | B2 | * | 10/2017 | Savard | E04C 2/044 |
| 10,125,457 | B1 | * | 11/2018 | Yin | E01D 19/125 |
| 2012/0311959 | A1 | | 12/2012 | Miedzik et al. | |
| 2017/0022699 | A1 | | 1/2017 | Lim | |

FOREIGN PATENT DOCUMENTS

| | | | | | |
|---|---|---|---|---|---|
| CN | 1206064 | A | | 1/1999 | |
| CN | 101016772 | A | | 8/2007 | |
| CN | 102812189 | A | | 12/2012 | |
| CN | 103243856 | A | | 8/2013 | |
| CN | 108487531 | A | * | 9/2018 | E04B 5/326 |
| DE | 1784150 | A1 | * | 7/1971 | E04B 5/21 |
| DE | 2241022 | A1 | * | 3/1974 | E04B 5/04 |
| DE | 3900594 | A1 | | 7/1990 | |
| DE | 202004018655 | U1 | * | 5/2005 | E04B 5/046 |
| DE | 202020106300 | U1 | * | 3/2021 | E04B 5/328 |
| EP | 2336445 | A1 | * | 6/2011 | E04B 5/328 |
| EP | 3045605 | A1 | * | 7/2016 | E04C 5/20 |
| FR | 481738 | A | * | 1/1917 | E04B 5/326 |
| FR | 561112 | A | * | 10/1923 | E04B 5/326 |
| FR | 671568 | A | * | 12/1929 | E04B 5/326 |
| FR | 2058768 | A5 | * | 5/1971 | E04B 5/02 |
| GB | 191420745 | A | * | 1/1915 | E04B 5/326 |
| GB | 1241179 | A | * | 7/1971 | E04B 1/161 |
| GB | 1286074 | A | * | 8/1972 | E04B 1/6158 |
| GB | 1349580 | A | * | 4/1974 | E04B 5/326 |
| JP | H094118 | A | | 7/1998 | |
| JP | 200127004 | A | | 1/2001 | |
| JP | 2001027004 | A | | 1/2001 | |
| JP | 2003227200 | A | * | 8/2003 | E04B 5/328 |
| JP | 2005133466 | A | * | 5/2005 | E04B 5/328 |
| JP | 2005163340 | A | * | 6/2005 | E04B 5/328 |
| JP | 2005220571 | A | * | 8/2005 | E04B 5/326 |
| JP | 2005282010 | A | * | 10/2005 | E04B 5/328 |
| JP | 2005320714 | A | | 11/2005 | |
| JP | 2006009363 | A | * | 1/2006 | E04B 5/328 |
| JP | 2006089994 | A | * | 4/2006 | E04B 5/328 |
| JP | 2006322137 | A | * | 11/2006 | E04B 5/328 |
| JP | 2007009670 | A | * | 1/2007 | E04B 5/328 |
| JP | 3990380 | B2 | | 10/2007 | |
| JP | 2008149598 | A | | 7/2008 | |
| JP | 2011220036 | A | * | 11/2011 | E04B 5/328 |
| JP | 201120036 | A | | 1/2013 | |
| KR | 20080108893 | A | | 12/2008 | |
| LU | 500046 | B1 | * | 10/2022 | E04B 5/328 |
| NL | 1025942 | C2 | * | 10/2005 | E04B 5/10 |
| WO | WO-9964693 | A1 | * | 12/1999 | E04B 5/328 |
| WO | WO-2010018989 | A2 | * | 2/2010 | E04B 5/328 |
| WO | WO-2010076757 | A9 | * | 10/2010 | E04B 5/328 |
| WO | WO-2015154132 | A1 | * | 10/2015 | E04C 5/0636 |
| WO | 2015182818 | A1 | | 12/2015 | |
| WO | 2015184476 | A1 | | 12/2015 | |
| WO | WO-2015182817 | A1 | * | 12/2015 | E04B 5/38 |
| WO | WO-2016020753 | A1 | * | 2/2016 | E04B 1/21 |
| WO | WO-2021019315 | A1 | * | 2/2021 | E04B 5/328 |

OTHER PUBLICATIONS

Translation for JP 2006009363 A. (Year: 2006).*
Translation for JP 2007009670 A. (Year: 2007).*
Translation of WO 9964693 A1. (Year: 1999).*
Korean Intellectual Property Off , "Notice of Preliminary Rejection", Korean Intellectual Property Office, Notice of Preliminary Rejection, Dec. 16, 2022, Application No. 10-2019-7029240, 9 pages, Dec. 16, 2022, 9 pages.
United Arab Emirates, Ministry of Economy , "Search Report", International Center for Patent Registration, Ministry of Economy, App. No. P6001283/2019, May 4, 2023, 9 pages, May 4, 2023, 9 pages.

* cited by examiner

BUILDING SYSTEM

FIELD OF THE INVENTION

The present invention relates to building structures and methods for erecting building structures.

The invention has been devised particularly, although not necessarily solely, in relation to multistorey building structures comprising components fabricated off-site in the form of prefabricated components.

BACKGROUND TO THE INVENTION

The following discussion of the background art is intended to facilitate an understanding of the present invention only. The discussion is not an acknowledgement or admission that any of the material referred to is or was part of the common general knowledge as at the priority date of the application.

The process of erecting a building structure is typically a costly and cumbersome exercise. This is particularly true of multistorey buildings, i.e. buildings having more than one storey above the basement and ground levels.

Prefabricated building structures are buildings that include components that are manufactured off-site and, prior to the process for erecting the building structure, the components are taken to the site. The components are built in a factory and shipped to the site. At site, the components are assembled together to erect the building structure, although there is usually a lot of on-site manufacturing and wet work involved to make such buildings structurally sound.

The process for assembling the components on-site typically is a cumbersome process and requires skilled labour as well as specialized machinery. This increases the cost for erecting a building structure based on prefabricated components. Many components cannot, to the Applicant's knowledge, be manufactured in a prefabricated manner as they are either too heavy and/or unwieldy to rapidly deploy on site if they are to be structurally sound, while the corollary is that the components that can generally be made off-site are not suitable for heavy load-bearing applications such as structural column units, beam units, and deck units (i.e. floor-forming components), or are unduly complex and require skilled workers such as boilermakers or wet trades on site.

It is against this background that the present invention has been developed and it would be advantageous if at least an embodiment of the present invention addresses at least some of the shortcomings of existing systems of which the Applicant is aware.

SUMMARY OF INVENTION

According to one aspect of the invention, there is provided a prefabricated structural beam unit for a building structure, the beam unit including:

a planar sole;

two laterally spaced, elongate sidewall sections; and two longitudinally spaced endwall sections, wherein the sole, sidewall sections and endwall sections may combine to define a cuboid cavity at least partially filled with a composite material, wherein at least one endwall section may include one or more structural engagement connectors dimensioned to engage with, or interlock, under gravity assistance with one or more complementary structural engagement connectors forming part of a further prefabricated building unit of the building structure.

The structural engagement connectors of one or both endwall sections each may be in the form of one or more protrusions extending from the endwall section, typically in the form of one or more cantilevered platforms extending laterally from the endwall sections and/or sole.

The endwall section structural engagement connectors may be connected to, or integral with the, or each, endwall section.

The, or each, cantilevered platform may be supported or reinforced by one or more reinforcement ribs extending from the endwall section.

The endwall structural engagement connectors each may be provided with apertures for receiving fasteners, to allow for the beam unit to be fastened securely to a further structural building unit, such as a column unit or deck unit according to an embodiment of the invention.

One or both sidewall sections may also include one or more structural engagement connectors shaped and dimensioned to interlock under gravity assistance with a further structural unit, typically a column unit or a deck unit according to an embodiment of the invention.

The sidewall structural engagement connectors may be flanges protruding from the sole and/or sidewall section and may be shaped and dimensioned to, in use, receive, support, and nest a deck unit in tight proximity, and perpendicular to, the structural beam unit.

The beam unit may include a reinforcing framework comprising a plurality of laterally spaced, elongate reinforcing bars internal to, and extending substantially the length of, the cuboid cavity. The elongate reinforcing bars may be encircled by a plurality of longitudinally spaced reinforcement steel bands.

The reinforcing framework may be overlaid with a plurality of transverse connectors extending between the two sidewall sections. The transverse connectors each may be in the form of an elongate rod having at least one adjuster connected thereto to allow for insertion of the transverse connectors between the sidewalls, and extension thereof using the one or more adjuster to securely urge the, or each, transverse connector to the sidewall sections. In certain embodiments, each transverse connector may have an adjuster connected at each end thereof, i.e. at or proximal the termini of the elongate rod.

The reinforcing framework may be securely attached to the transverse connectors, typically by spot welding. The reinforcement framework may also, in certain embodiments, be secured to the endwall sections.

Alternatively, or additionally, the reinforcing framework may be attached directly or indirectly (i.e. via intermediary connectors) to the sidewall sections and/or sole at intermittent distances along the lengths of the sidewalls.

The sole may have provided thereupon one or more shear lugs, to counter downward deflection of the beam unit. The shear lugs may be welded to the sole and be dimensioned to extend at least partially into an interior cavity defined by the reinforcing framework. The above arrangement allows for the beam unit to be much thinner in cross-section, and thus lighter, than conventional prefabricated units while still retaining sufficient strength and rigidity.

The adjusters of the transverse connectors each may include gripping formations to allow for the transverse connectors to be fastened to the sidewall sections by hand or using light manual tools.

The sidewalls further include interspaced apertures in which the transverse connectors may be snugly received when the transverse connectors are extended using the adjusters and through which connecting rods may pass when securing prefabricated deck units to the beam unit during assembly of the building structure. The adjusters may be in the form of a keyed, threaded sleeve, threadedly mounted on the transverse connector. The adjuster may include a flanged face to facilitate tightening by hand.

The elongate reinforcing bars may be interconnected using a plurality of longitudinally spaced constriction sleeves, the constriction sleeves being in the form of bent metal bars extending at least partially around a bundle of reinforcing bars.

The sidewall sections and endwall sections may extend a similar distance operatively upwardly from the planar sole.

The cuboid cavity may be charged with the composite material up to an upper edge of the sidewalls and endwall.

A further aspect of the invention relates to a formwork module for a prefabricated structural beam unit for a building structure, the formwork module including:

a planar sole;

two laterally spaced, elongate sidewall sections; and two longitudinally spaced endwall sections, wherein the sole, sidewall sections and endwall sections may combine to define a cuboid cavity dimensioned to receive a charge of composite material, wherein at least one endwall section may include one or more structural engagement connectors dimensioned to engage with, or interlock, under gravity assistance with at least one complementary structural engagement connector forming part of a further building element of the building structure, the formwork module further including a framework comprising a plurality of laterally spaced, elongate reinforcing bars extending substantially the length of the cuboid cavity, the formwork including a further integrated pre-formed structural engagement connector.

According to a further aspect of the invention, there is provided a prefabricated structural column unit for a building structure, the column unit including:

at least one integrated, pre-formed bracket providing at least one structural engagement connector on an outer surface of the column unit, the structural engagement connector being shaped and dimensioned to support, or interlock with, one or more complementary structural engagement connectors forming part of a further building element, such as a beam unit, under gravity assistance.

The at least one structural engagement connector may be in the form of one or more protrusions provided on, or proximal, an outer surface of the column unit, for supporting and engaging with complementary structural engagement connectors provided on a prefabricated structural beam unit according to an embodiment of the invention.

The protrusions may typically be in the form of one or more cantilevered platforms extending outwardly from the column unit.

The one or more cantilevered platforms each may be provided with support ribs extending upwardly from the bracket to support the platform when a beam unit received on a column unit platform.

The column unit structural engagement connectors each may be provided with apertures for receiving fasteners, to allow for a building element such as a beam unit to be fastened securely to the column unit.

The apertures may be spaced on each platform such that they are substantially in register with complementary apertures provided on the structural engagement connectors of the beam unit when the column unit and beam unit are positioned correctly relative to one another during the assembly process, thereby to facilitate connection of the beam and column units by hand or using manual tools.

The structural engagement connectors may be provided on one external surface of the column unit, or on two diametrically opposed external surfaces of the column unit, as required.

The column unit may include an internal reinforcing framework comprising a plurality of laterally spaced metal (typically steel) rods extending substantially the length of the column unit. The elongate reinforcing bars may be interconnected using a plurality of constriction sleeves, the constriction sleeves being in the form of longitudinally spaced bent metal bars extending at least partially around a bundle of reinforcing bars.

The bracket may be attached to the internal reinforcing framework of the column unit. Alternatively, or additionally, the bracket may be attached to an external surface of the column unit.

The bracket may include at least two connector plates that extend at least partially between each of the external structural engagement connectors, the connector plates straddling the reinforcing framework of the column unit. The two connector plates may be connected to each other using two transverse connectors extending between the internal, facing, surfaces of the connector plates. The transverse connectors each are provided with adjusters for adjusting the length thereof. The adjusters each may be in the form of a keyed, threaded sleeve, threadedly mounted on the transverse connector. The adjuster may include a flanged face to facilitate tightening by hand. The transverse connectors may pass through a void formed internal to the reinforcing framework.

The bracket further may include at least one lip formation extending from an operatively lower surface of the connector plate for receiving an end of a deck unit.

The column unit may have terminal attachment formations formed integrally therewith on, or toward, at least one end thereof to allow for the fixing of the column unit to a foundation or piling using mechanical locking means, such as mechanical fasteners. The terminal attachment formations may form part of the internal reinforcing framework.

The column unit may be provided with hollow grout tubes internal to the reinforcing framework. This allows for the placement and fixing of one or more column units on top of each other in a longitudinally extending fashion, and delivering a charge of high strength grout down the lengths of the combined hollow grout tubes, once they are in register. A further aspect of the invention relates to a reinforcing framework for a structural column unit for a building structure, the reinforcing framework including:

a plurality of laterally spaced, elongate reinforcing bars extending substantially the length of a desired column unit to be constructed, and;

at least one integrated, pre-formed bracket that may provide at least one structural engagement connector on an outer surface of the framework at a locus on the framework commensurate with an intended floor height of the building structure when the column unit is secured in position on site.

According to a further aspect of the invention, there is provided a prefabricated structural deck unit for a building system, the deck unit including a reinforcing framework encased in a composite material, the reinforcing framework comprising a first, operatively lower, metal mesh unit, a plurality of interspaced spheroidal void formers attached to or in intimate contact with the first mesh unit, and a second, operatively upper, mesh unit resting upon, or attached to, the spheroidal void formers, the framework defining at least one terminal channel on at least one end of the deck unit, the terminal channel being shaped and dimensioned to snugly receive an elongate connecting rod for connecting the deck unit to a further structural element of the building system, such as a beam unit.

The spheroidal void formers each may have a generally spheroidal body that is cinched at the waist, typically below a midline of the spheroidal body. The cinched waist of the spheroidal body defines an operatively lower lip that serves as a circumferentially extending seat for receiving the composite material. The provision of the cinched body lessens the probability of the spheroids floating when a composite material is added to the cuboid cavity. It may also increase purchase of the composite material on the spheroidal void formers.

Each spheroidal body further may include two or more radially spaced arms, each arm being provided with a distal connector for connecting the void former to the reinforcing framework. The connector on each arm is shaped and dimensioned to attach or connect in a friction, slight interference, or snap fit manner with the rebar or framework to which the spheroidal void former is to be attached.

The spheroidal void former is typically used between two sheets of framework and, as such, may have four radially splayed arms each with a distal connector, with two arms spaced and positioned to engage with the operatively upper framework and two arms spaced and positioned to engage with the operatively lower framework.

The arms and connectors may be integrally formed with the spheroidal body. The spheroidal body may have an indented crown shaped and dimensioned to entrap a charge of the composite material.

The body may be manufactured in bisected mirror-fashion, allowing a single mould to be used to manufacture two interlocking halves of the spheroidal body and allowing for the halves of the spheroidal body to be transported in nested fashion and rapidly assembled on site.

Preferably, the reinforcing mesh is positioned in a formwork mould by resting on a series of spacer chairs that serve to elevate the reinforcing framework from a lower surface of the formwork mould.

Preferably, each spacer chair includes a body defining a spacer chair seat, the seat being supported by four legs which are connected to each other by cross struts so as to prevent the legs spreading relative to each other beyond their desired configuration. Preferably, said seat incorporates a threaded hole into which a multi-clip body can be inserted. Preferably, said multi-clip body incorporates two pairs of clips arranged such that each pair of clips attach to the rods of the reinforcing mesh, such rods being arranged in a two sets of multiple parallel rods, with each set of parallel rods being orientated at right angles to one another such that the mesh is composed of a regular series of rectangles, the perimeter of which is formed by reinforcing rods.

The prefabricated deck may comprise a plurality of ferrules attached to the reinforcing framework. The plurality of ferrules may be configured to attach to respective magnets. The plurality of ferrules may be configured such that when each ferrule is attached to a magnet, the magnet holds the reinforcing framework attached to a steel bed of a mould in which the deck unit is cast. The prefabricated deck unit may comprise 4 or 6 ferrules that are arranged symmetrically relative to the reinforcing framework.

At least one sidewall of the prefabricated deck unit may be tapered such that when two prefabricated deck units are positioned next to one another, a recess between the two deck units is formed. The recess may be substantially V-shaped. The at least one sidewall may comprise one or more grooves.

The composite material may be concrete, grout, mortar or any other cementitious material.

In a further aspect of the invention, there is provided a method of making a prefabricated deck unit, for example casting. The method may comprise the steps of providing a formwork mould, positioning a first reinforcing mesh unit within the formwork mould, positioning a plurality of interspaced spheroidal void formers on the first reinforcing mesh unit, positioning a second reinforcing mesh unit such that the second reinforcing mesh unit rests or is attached to the plurality of spheroidal void formers, and pouring a composite material into the formwork mould comprising the first and second reinforcing mesh units and the plurality of spheroidal void formers. The method may further comprise positioning at least one elongate connecting rod within a terminal channel of the deck unit, the terminal channel being on at least one end of the deck unit, and connecting the at least one connecting rod a further structural element of the building system. A composite material may be inserted into gaps between the at least one connecting rod and the terminal channel.

In one example, the method may comprise a step of attaching a plurality of ferrules to the first reinforcing mesh unit, wherein the plurality of ferrules are configured to attach to respective magnets for holding the first reinforcing mesh unit to the formwork mould. The method may comprise a step of attaching a plurality of magnets to respective ferrules. The magnets may be removed once the deck units has been cast. The composite material may be inserted into the formwork mould from a substantially central position relative to the deck unit.

Accordingly, the invention extends in another aspect thereof to a spheroidal void former including a spheroidal body, at least two arms, preferably four, extending radially outwardly from the spheroidal body, each arm having a connector formed integrally with the arm, wherein the body of the void former is cinched at the waist.

The spheroidal body may include an indented crown and further features as discussed above.

According to yet another aspect of the invention, there is provided a prefabricated pod unit, such as a prefabricated bathroom unit, the pod including:

a 3-dimensional frame structure defining an outer perimeter of the pod unit, the frame structure having a lower base frame, at least four uprights extending upwardly from the lower base frame, and a circumferentially extending upper frame connected to the uprights, the upper frame and/or uprights each having attached thereto laterally spaced adjustment connectors, each adjustment connector being in the form of a bracket having an upper connecting end for connecting to one or more prefabricated units according to an embodiment of the invention, and a lower connecting end connected to the upper frame and/or upright, the bracket being provided with a vertical adjustor extending between the upper connecting end of the bracket and the lower connecting end thereof.

The in another aspect of the invention, there is provided a method of levelling a prefabricated pod, such as a prefabricated bathroom unit, the method including the steps of:

providing a 3-dimensional frame structure defining an outer perimeter of the pod, the frame structure having a lower base frame, at least four uprights, and a circumferentially extending upper frame, the upper frame and/or uprights each having attached thereto laterally spaced adjustment connectors, each adjustment connector being in the form of a bracket having an upper connecting end for connecting to one or more prefabricated units according to an embodiment of the invention, and a lower connecting end connected to the upper frame and/or upright, the bracket being provided with a vertical adjustor extending between the upper connecting end of the bracket and the lower connecting end thereof;

connecting the upper end of the bracket to the prefabricated unit according to an embodiment of the invention, such that the prefabricated pod is suspended from the prefabricated unit; and adjusting each connector via the adjustment nut to level the pod while it depends from the prefabricated unit.

The vertical adjustor may be in the form of an adjusting nut that is threadedly mounted on an adjustment strut extending between the upper connecting end of the bracket and the lower connecting end thereof.

The adjustor may be captive within the bracket.

According to another aspect of the invention, there is provided a building system, the building system including complementarily inter-engaging column units, beam units, and deck units as described herein.

The building system also may include a prefabricated pod unit according to an embodiment of the invention.

According to a further aspect of the present invention, there is provided a method of constructing a multistorey building, the method including the steps of:

providing at least two prefabricated column units according to an embodiment of the invention;

interlocking the one or more engagement formations of at least one prefabricated beam unit according to an embodiment of the invention with one or more engagement formations of the column unit; and providing at least one deck unit according to an embodiment of the invention and locking the deck unit securely to the beam unit and/or column unit according to an embodiment of the invention using one or more connecting rods.

The method may include the step of manufacturing all prefabricated components at a manufacturing plant off-site. The various units (column, beam & deck units) may then be delivered to site according to an assembly schedule, lifted and placed into position and then secured using mechanical fasteners, fastenable by hand or using light manual tools or, if desired, power tools.

The precast column units are equipped with grout tubes that are installed into the reinforcing framework. The grout tubes are sealed with a plug to prevent cement from entering. Once the precast column is poured, the column units are delivered to site. Advantageously, the columns may be in the form of a pre-cast unit that is 1, 2, 3 or 4 stories high and therefore also possesses structural engagement connectors commensurate with the desired number of stories. During the assembly stage of the units, the grout tubes are unplugged and thus allow for the placement and fixing of one or more column units on top of each other in a longitudinally extending fashion. This is accomplished by delivering a charge of high strength grout in combination with reinforcement bars into each grout tube. The set precast column units may then be delivered to site, lifted, and placed into position. The column units therefore offer a quick and simple installation and can be connected for multiple storeys.

The method may include the step of providing at least one beam unit, which may be lifted, placed in position between column or between a column and a wall, and secured by mechanical fasteners, typically in the form of threaded rods and nuts. The method may include the step of fastening a flange to one or both of the bracket connector plates provided on the column. The flanges are secured at a height commensurate with the intended depth of the deck units, such that it may serve to support a section of a deck unit that protrudes past the beam at a level commensurate with the level of the deck unit defined by the depth of the supporting flange on the sidewall of the beam unit.

The method may include the further step of providing at least one, but typically a plurality of deck units, which are placed perpendicularly to the beam unit. In other words, the ends of the deck units rest on the bottom flanges provided on the sidewalls of the beam units. Once placed, the deck unit can be loaded immediately. A starter bar is provided on the deck unit is aligned within the voids formed in the ends of the deck unit, and screwed into the beam unit. The method may include the further step of providing additional reinforcement bars that are inserted into the beam unit and the deck unit to increase strength and maintain continuity throughout the structure. The method may include a further step of grouting any of the units or interfaces where the units meet, if desired.

In a further aspect of the invention, there is provided a building structure assembled using the building system and/or one or more prefabricated column units, beam units or deck units according to embodiments of the invention.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENTS

Figure 1:
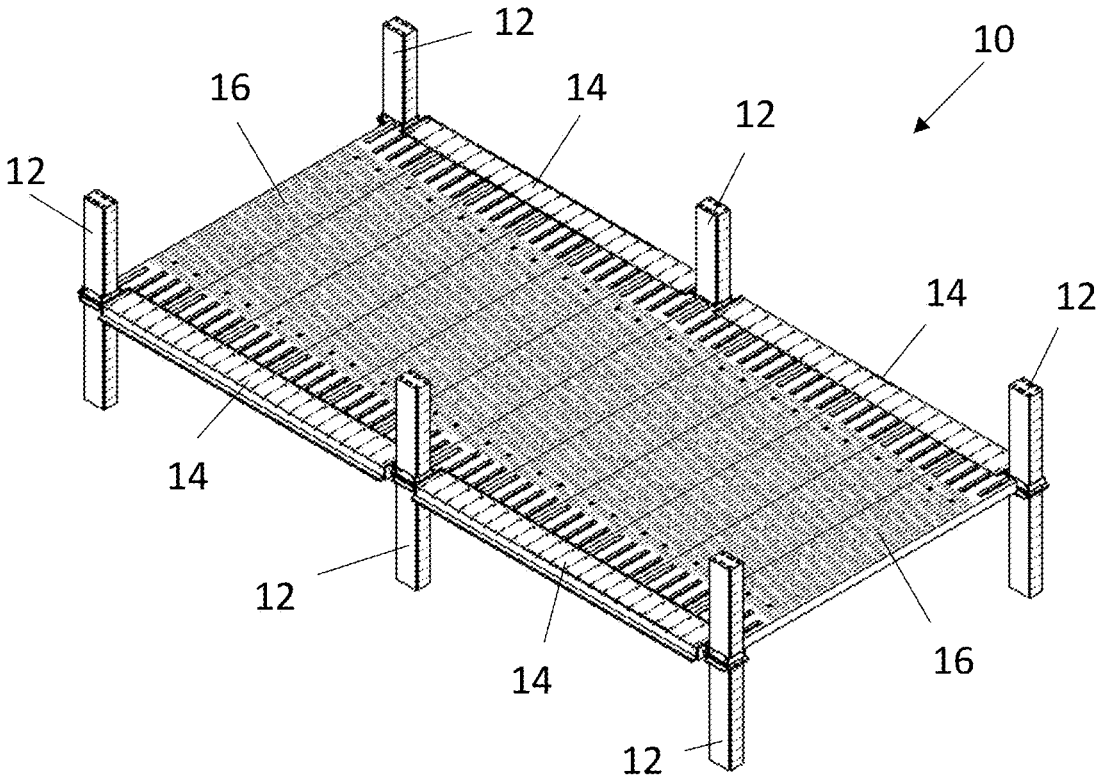
FIG. 1 shows a 3-D view of a building system of an embodiment of the invention including 6 column units, 4 beam units suspended between the 6 column units, and 12 deck units spanning between the beam units.

With reference to the drawings, reference numeral 10 refers generally to a building system according to an embodiment of the invention.

FIG. 1 shows a building system 10 in accordance with one aspect of the invention, the building system including a plurality of column units 12, supporting beam units 14 that, in turn, support deck units 16.

Figure 2:
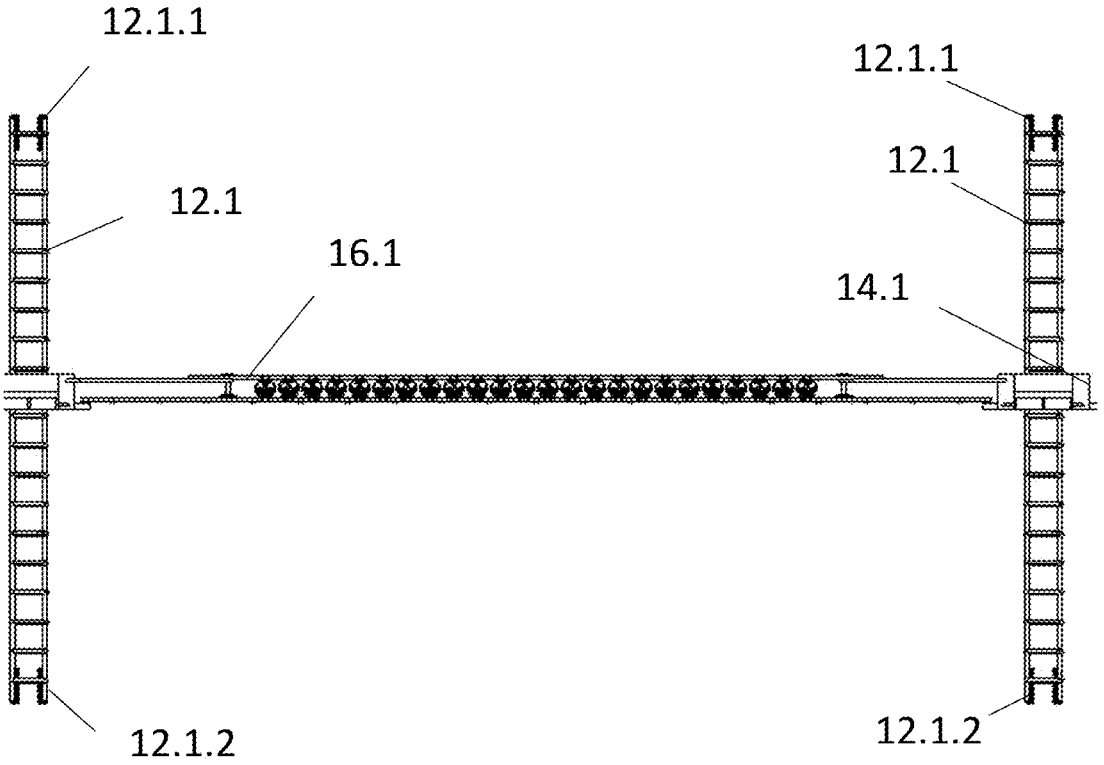
FIG. 2 shows a side view of a framework of a prefabricated deck unit of an embodiment of the invention (i.e. a view without composite materials) suspended between two beam units, each beam unit being shown in end view, and attached to a column unit.

FIG. 2 shows the internal frameworks of two column units 12.1, internal frameworks of two beam units 14.1, and an internal framework of two deck units 16.1 suspended between the beam units frameworks 14.1.

Each column unit framework 12.1 includes operatively upper and lower ends, indicated by reference numerals 12.1.1 and 12.1.2, respectively.

Figure 3:
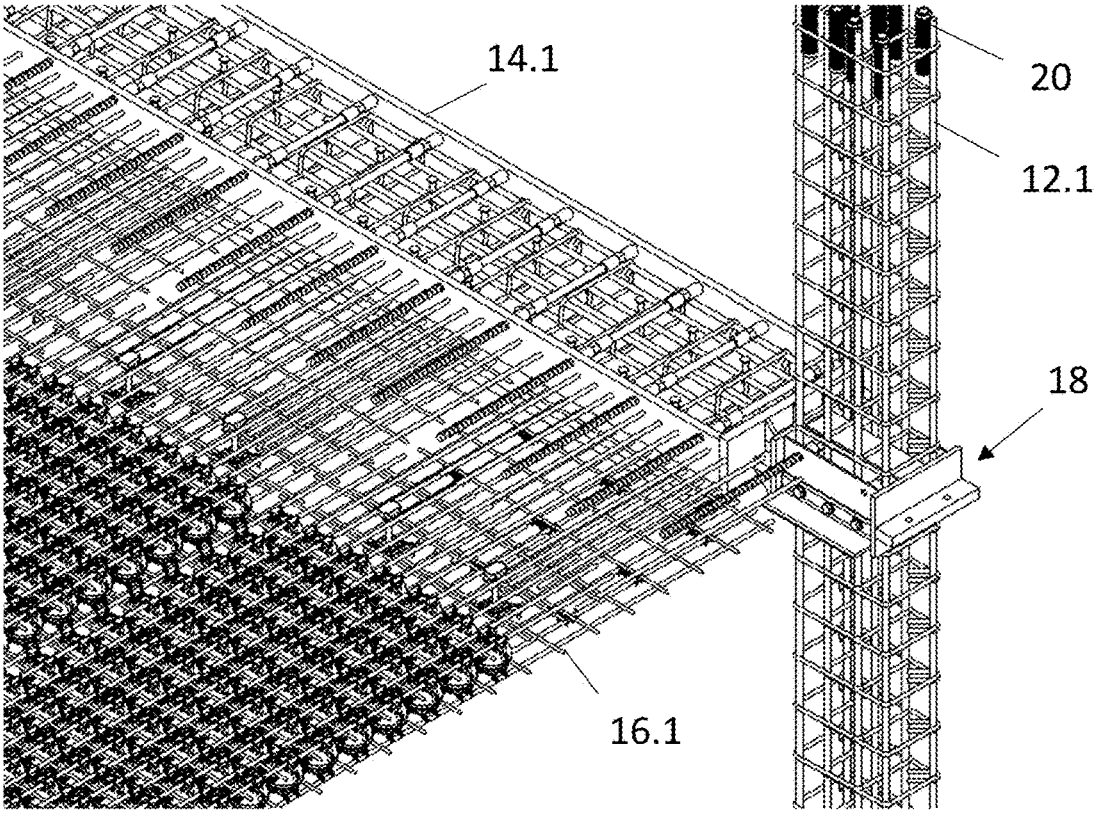
FIG. 3 shows a 3-D view of a framework of a column unit, a beam unit attached to the column unit, and three deck units being supported by the beam unit.

As shown in FIG. 3, each column unit framework 12.1 includes a bracket 18 extending around the framework 12.1. The bracket 18 is attached to the column framework 12.1 off-site and may become part of the column 12 when the column 12 is cast (see in particular FIG. 12). Casting (not shown) typically occurs on a casting bed using external formwork conforming generally to the intended outer surface and dimensions of the column 12 shown in the drawings. Also shown in this Figure is a plurality of hollow grout tubes 20 (best shown in FIG. 10) which are charged with a high-strength cementitious grout, typically 50 mPa concrete, when one or more column units 12 are to be attached vertically to one another.

Figure 4:
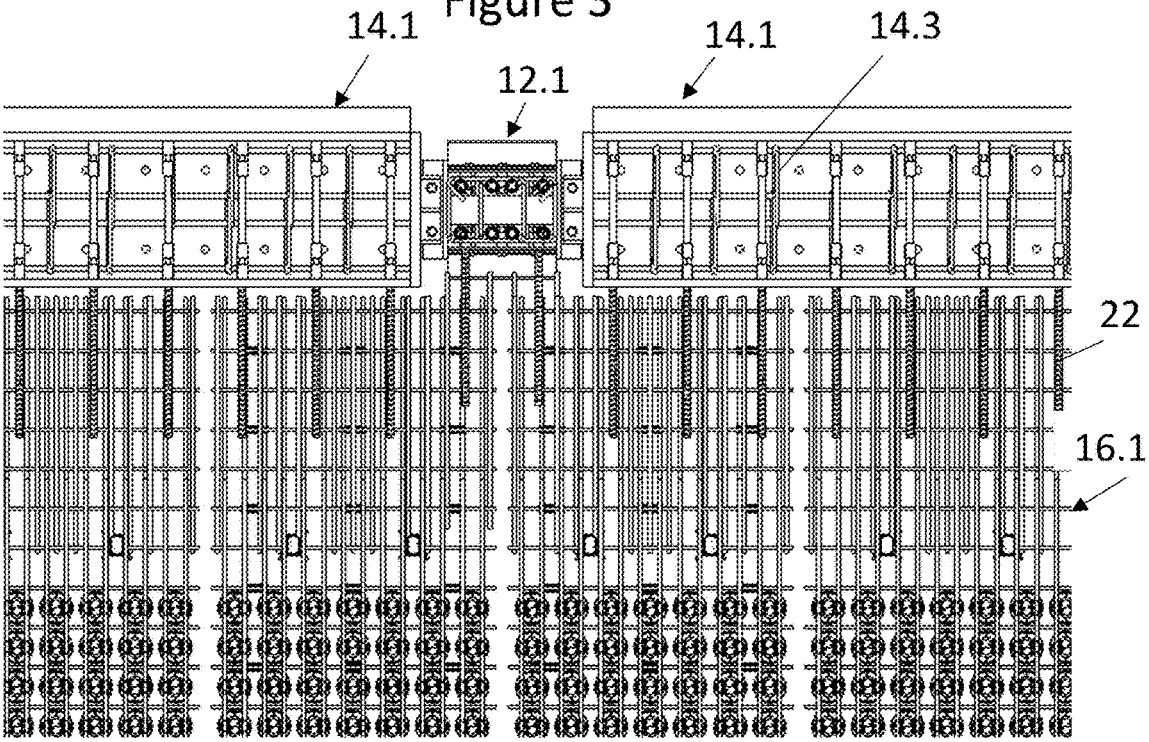
FIG. 4 shows a top plan view of a section of a building system according to an embodiment of the invention, shown in framework.

FIG. 4 shows a top plan view of the building system 10, showing a column unit framework 12.1, beam unit framework 14.1, and a plurality of deck unit frameworks 16.1. A plurality of starter rods 22 are shown, which are provided to connect a beam unit 14 to a deck unit 16, although only the frameworks for each are shown to aid clarity in FIG. 4. The assembly process is discussed in greater depth below.

Figure 5:
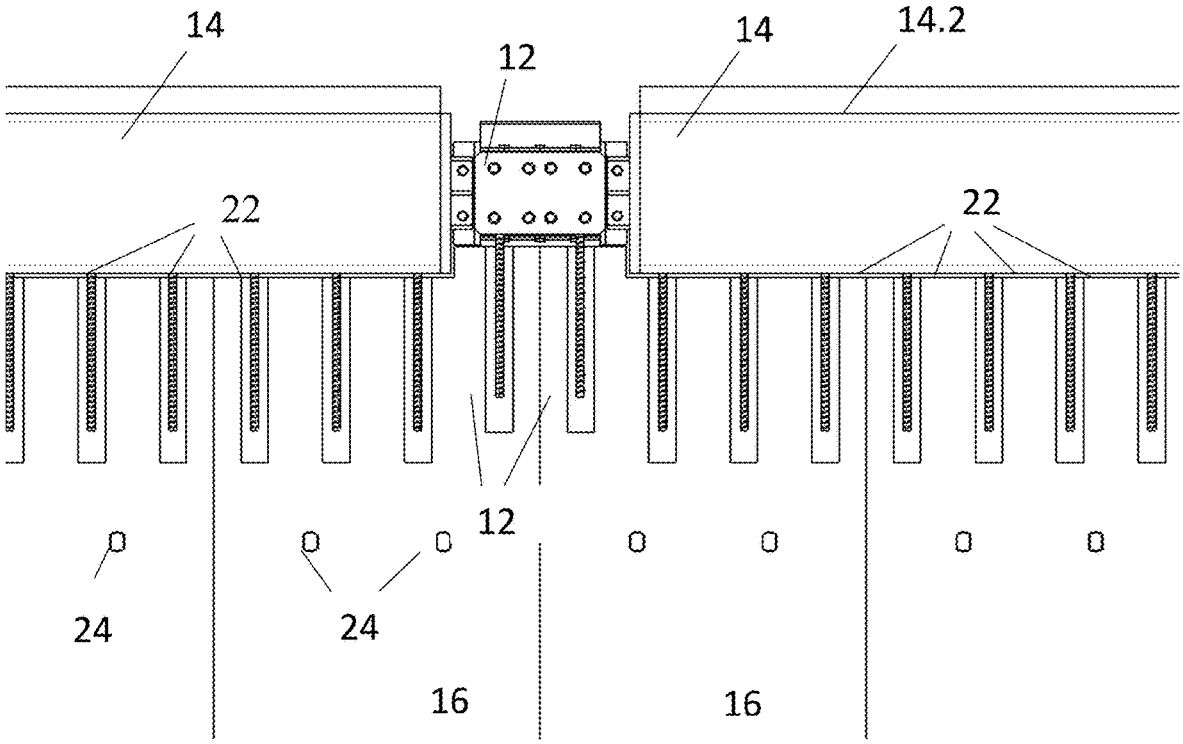
FIG. 5 shows the same top plan view the section of FIG. 4, including composite material (i.e. cementitious materials) over the framework.

FIG. 5 shows a top plan view of the building system 10 of FIG. 4, wherein the starter rods 22 are clearly visible, prior to being grouted in to aid stability of the structure. In certain embodiments, the starter rods 22 pass through, or are attached to, a lateral sidewall 14.2 of a beam unit 14, or to internal connecting rods 14.3 forming part of the framework 14.1 of each beam unit 14, serving to tie together deck units 16 on either side of each beam unit 14 to aid strength and rigidity. This is more clearly shown and discussed with reference to FIG. 35 below.

Figure 6:
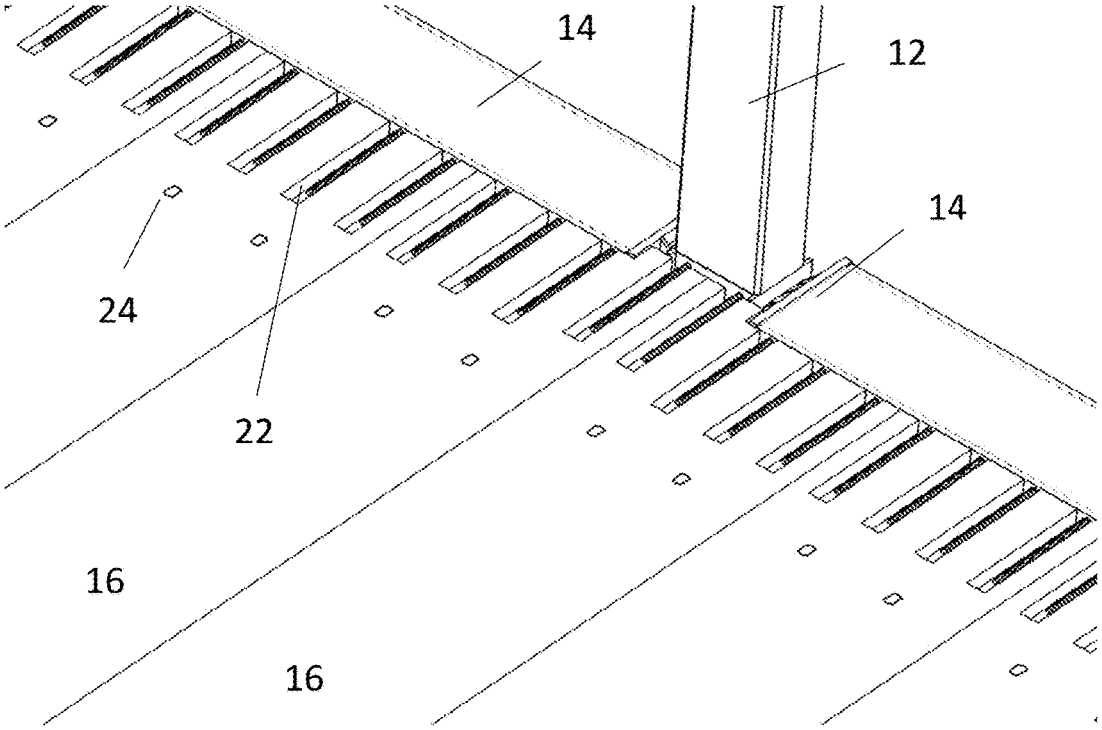
FIG. 6 shows a 3-D view of the elements shown in FIG. 5.

FIG. 6 shows the building system 10 of FIG. 5, but using the final, prefabricated units 12, 14, and 16 formed with composite materials (after the units have been cast). FIGS. 5 and 6 also show lifters 24, that are used to lift each of the deck units 16 during manufacturing, and also when lifting the finalised prefabricated deck units 16 into place in situ on a building site.

Figure 7:
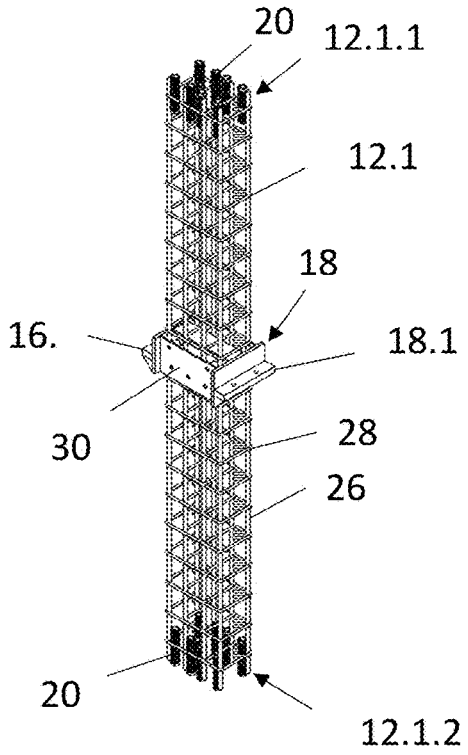
FIG. 7 shows a 3-D view of a framework of a column unit according to an embodiment of the invention, including terminal attachment formations at each end thereof, and a central bracket extending around, and attached to, the framework.
Figure 8:
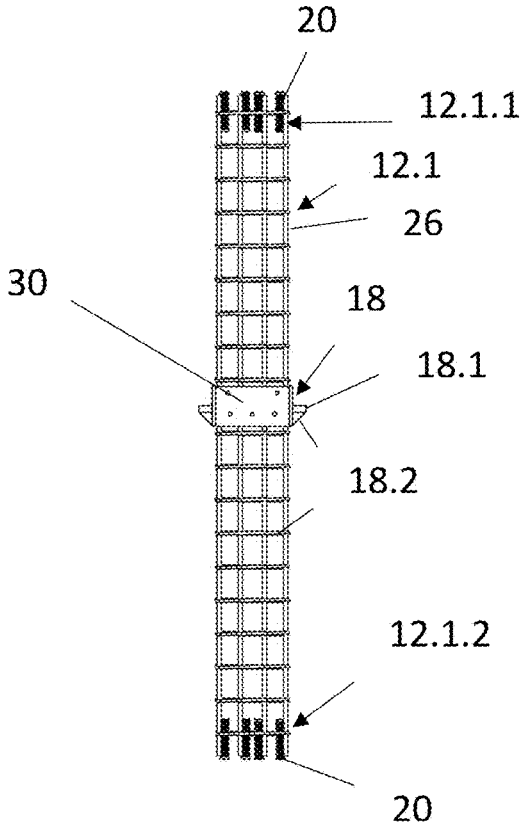
FIG. 8 shows a side view of the framework of the column unit of FIG. 7.
Figure 8A:
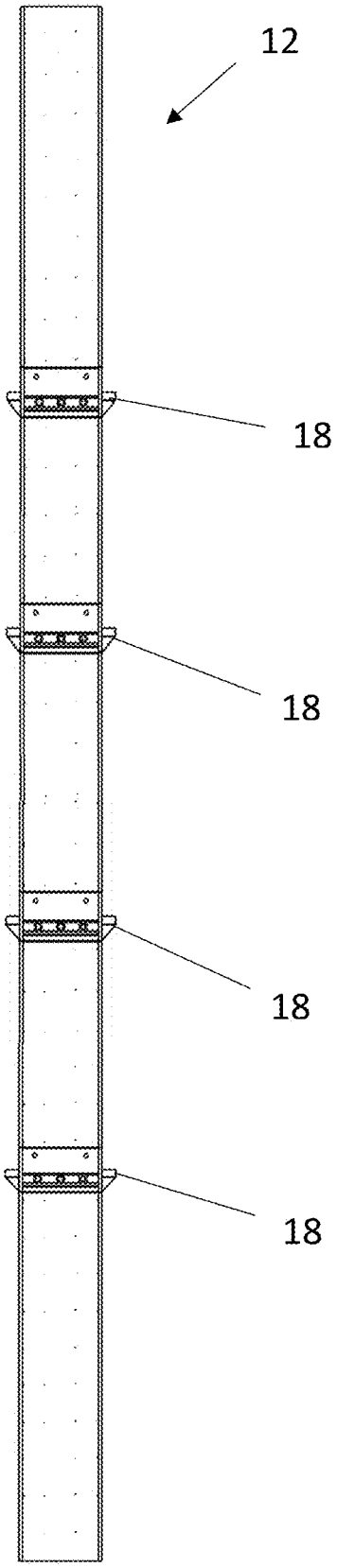
FIG. 8A shows a side view of a column unit according to an embodiment of the invention with four brackets and structural engagement connectors corresponding to a four storey assembly.
Figure 9A:
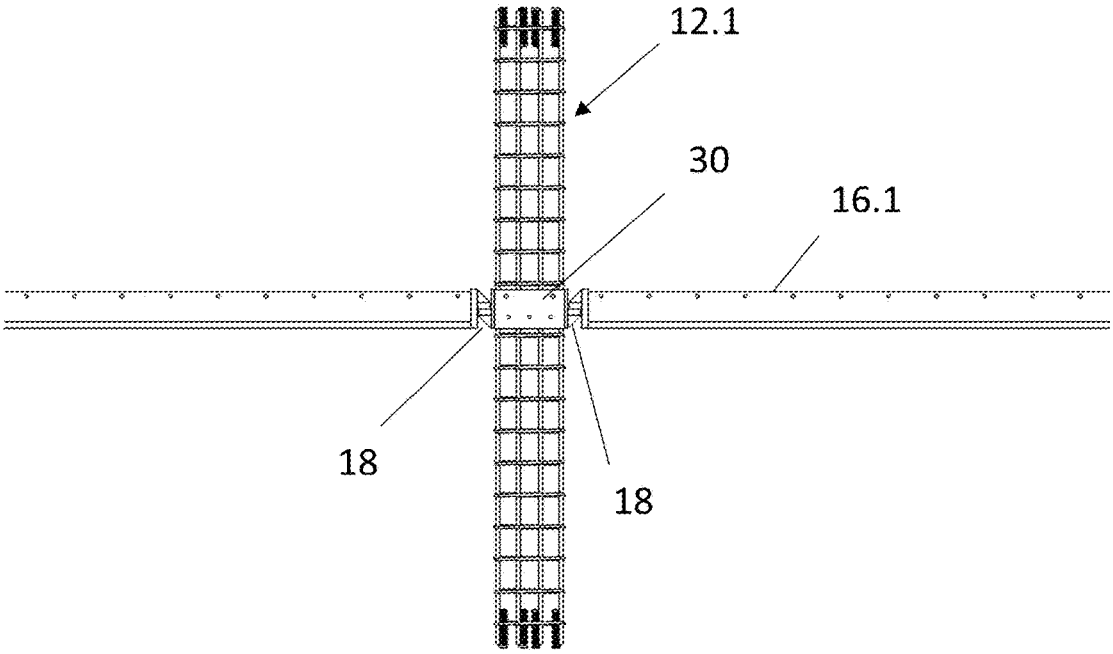
FIG. 9 shows a side view of the framework of FIG. 8, supporting two beam units on either side thereof.

FIGS. 7 and 8 show details of the framework 12.1 of the column unit 12. The framework 12.1 includes elongate reinforcing bars in the form of steel rods 26 which extend the length of the column unit 12. The steel rods 26 are encircled by a bracket 18, that includes two structural engagement connectors 18.1, each being shaped and dimensioned to support, or interlock with, one or more complementary structural engagement connectors forming part of a beam unit 14 under gravity assistance. The brackets 18 are typically in the form of cantilevered platforms 18.1 that, in the embodiment shown, are supported by upwardly extending ribs 18.2, as shown in FIGS. 9 and 10, but more clearly in FIGS. 11 and 12.

Returning to FIGS. 7 to 10, the elongate steel rods are interconnected and stabilised using a plurality of constriction sleeves 28, the constriction sleeves 28 being in the form of longitudinally spaced bent metal bars extending at least partially, typically completely, around a bundle of reinforcing bars or rods 26.

Figure 11:
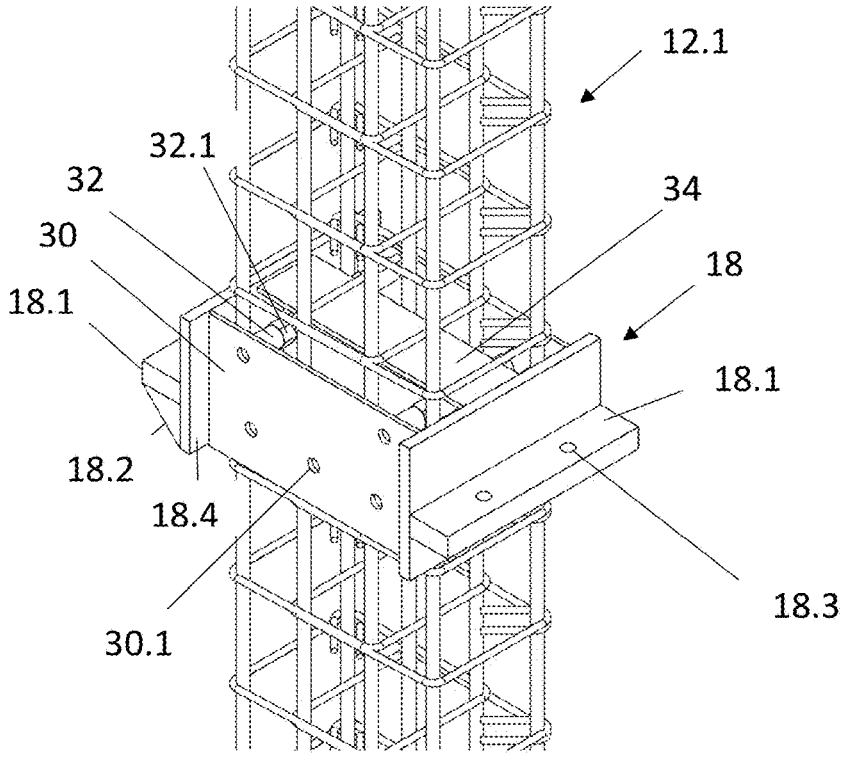
FIG. 11 shows a 3-D view of the bracket attached to the frame work of the column unit of FIG. 10, including the structural engagement connectors (platforms) extending laterally outwardly from the bracket.
Figure 12:
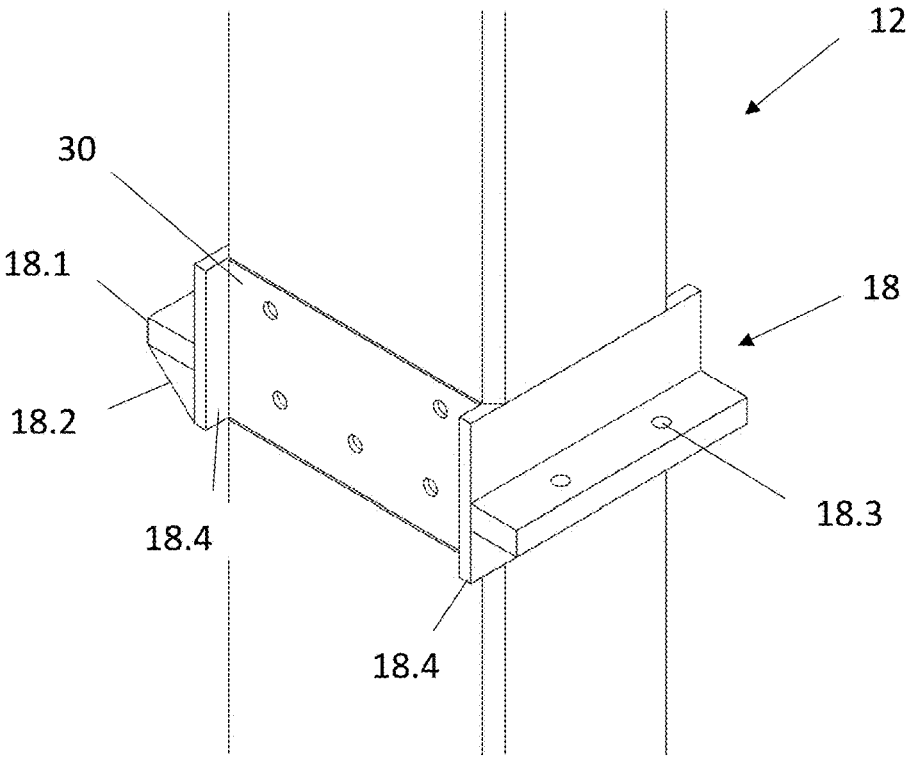
FIG. 12 shows a 3-D view of the bracket attached to a finished column unit according to an embodiment of the invention, including the structural engagement connectors (platforms) extending laterally outwardly from the bracket.

In FIGS. 11 and 12, it can be seen that the bracket 18 includes not only the diametrically opposed platforms 18.1, but also connector plates 30 that serve to connect opposite platforms 18.1. The connector plates 30 are connected to each other by transversely extending connectors 32 that span through an interior of the framework 12.1. The connector plates 30 straddle the reinforcing framework 12.1 of the column unit 12.

Figure 20:
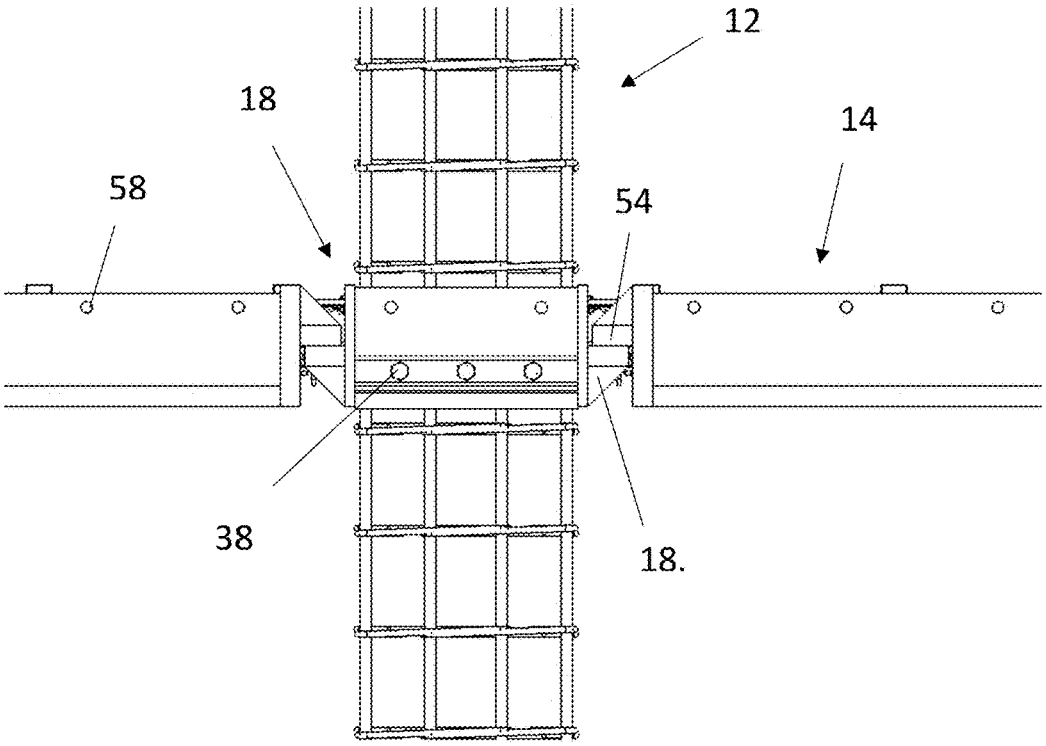
FIG. 20 shows a side view of the arrangement of FIG. 19, with two flanges attached to the connector plates of the bracket attached to the column.

Each platform 18.1 is shaped to complementarily engage similar structural engagement connectors provided on the beam units 14. This is best shown in FIG. 20. As such, each platform 18.1 has apertures 18.3 defined for receiving fasteners (shown in and described in FIG. 21 by reference numeral 60), to allow for the beam unit 14 to be fastened securely to the column unit 12. The apertures 18.3 are spaced on each platform 18.1 such that they are substantially in register with complementary apertures provided on like, inverted platforms, provided on the beam unit 14, as discussed in greater detail below. This facilitates correct positioning of the beam unit 14 relative to the column unit 12 during the assembly process, thereby to facilitate connection of the beam and column units 14, 12 by hand or using manual tools.

In this particular example, the platforms 18.1 of the bracket 18 each include a back plate 18.4 which extends out further than the transverse cross-section of the bracket 18 or the column unit framework 12.1, so that when the column unit 12 is cast, the backplate 18.4 also protrudes past the exterior of the column unit 12. As discussed in further details below, this is useful to locate and contain ends of deck units 16 that are to be placed proximal the column unit 12 during assembly.

The transverse connectors 32 each are provided with adjusters 32.1 (similar to those shown more distinctly in the beam unit in FIGS. 17 and 19) for adjusting the length of the transverse connectors 32 and for locking the transverse connectors 32 in place between the connector plates 30. The adjusters 32.1 each are in the form of a keyed, threaded sleeve, threadedly mounted on the transverse connector 32. In this particular example, the adjuster 32.1 is in the form of a hexagonal flange or sleeve to facilitate tightening by hand.

The bracket 18 includes a further connector plate 34 that extends through the framework 12.1 between the upper edges of each base plate 18.4, while a similar plate (not shown) extends between the lower edges of each base plate 18.4.

Figure 13:
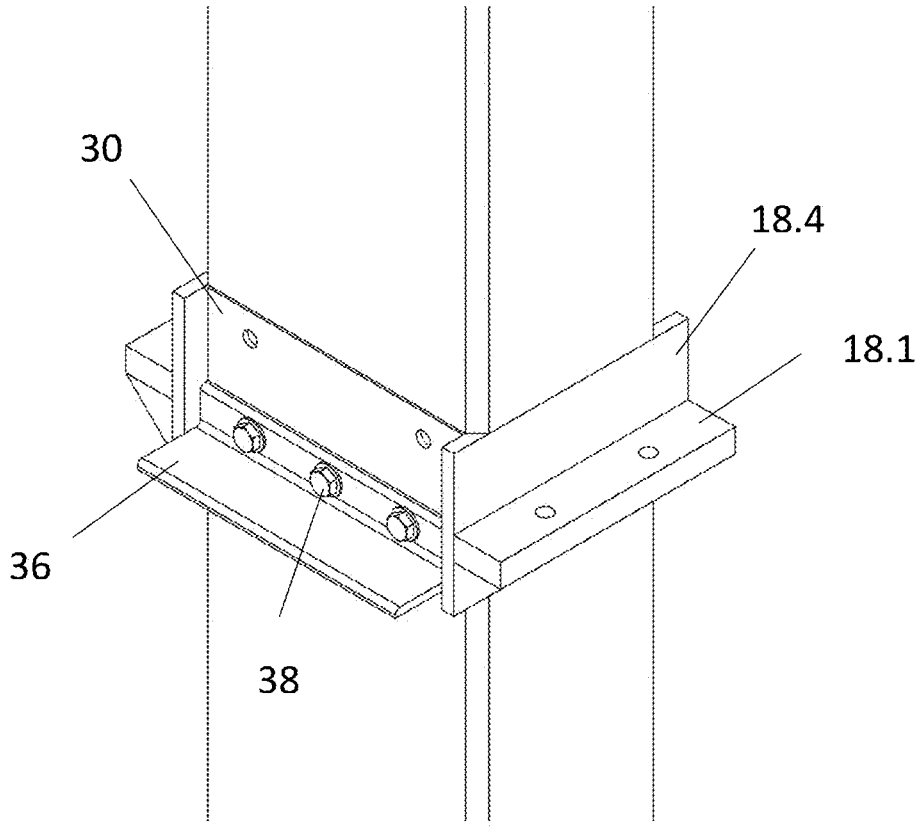
FIG. 13 shows a 3-D view of the bracket and platform of FIG. 12, further having a flange attached thereto for supporting an end of a deck unit.

In this example and shown in FIG. 13, the bracket 18 includes a lower flange or lip formation 36 that is bolted to an operatively lower surface of the connector plate 30. Bolts 38 pass through apertures defined in the flange or lip formation 36, and are received within the interiors of the transverse connectors 32 that are complementarily threaded. The lower flange or lip formation 36 is positioned relative to the height of the platform 18.1, such that it will receive a lower surface of a deck unit 16 to be supported by the beam unit 14.

Referring back to FIGS. 10A 10B, there is shown a 3D-view and a top plan view of the column unit 12, showing the grout tubes 20 attached to the reinforcing framework 12.1. The grout tubes 20 may be used for the placement and fixing of one or more column units 12 on top of each other in a longitudinally extending fashion, or on top of a footing of a building.

Figure 10A:
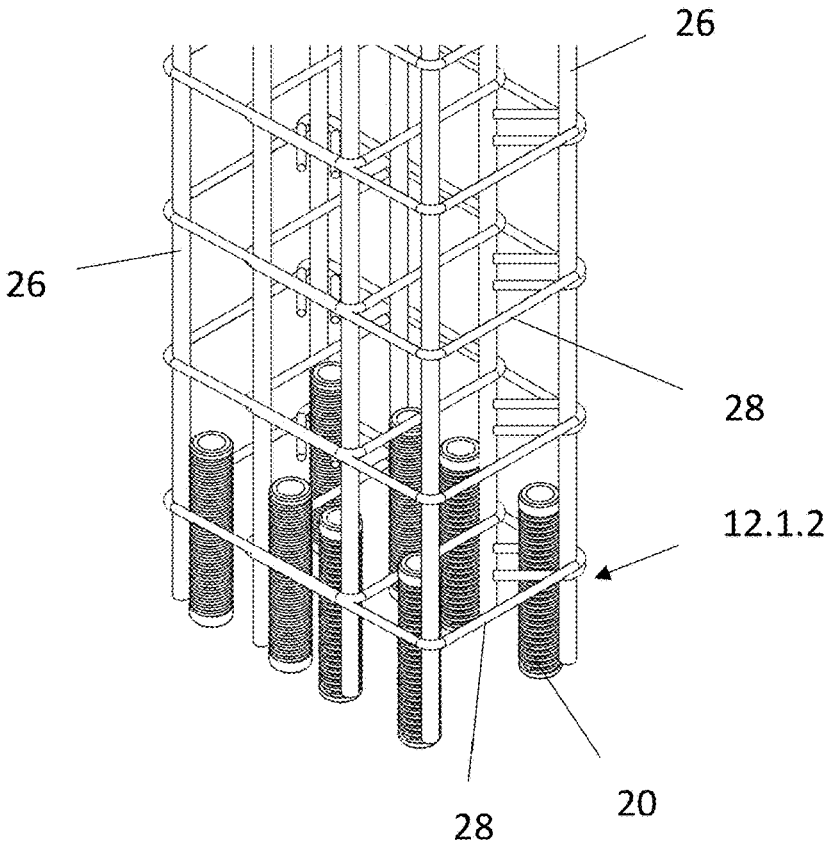
FIG. 10A shows a 3-D view of the terminal attachment formations of the column unit of FIG. 9.
Figure 10B:
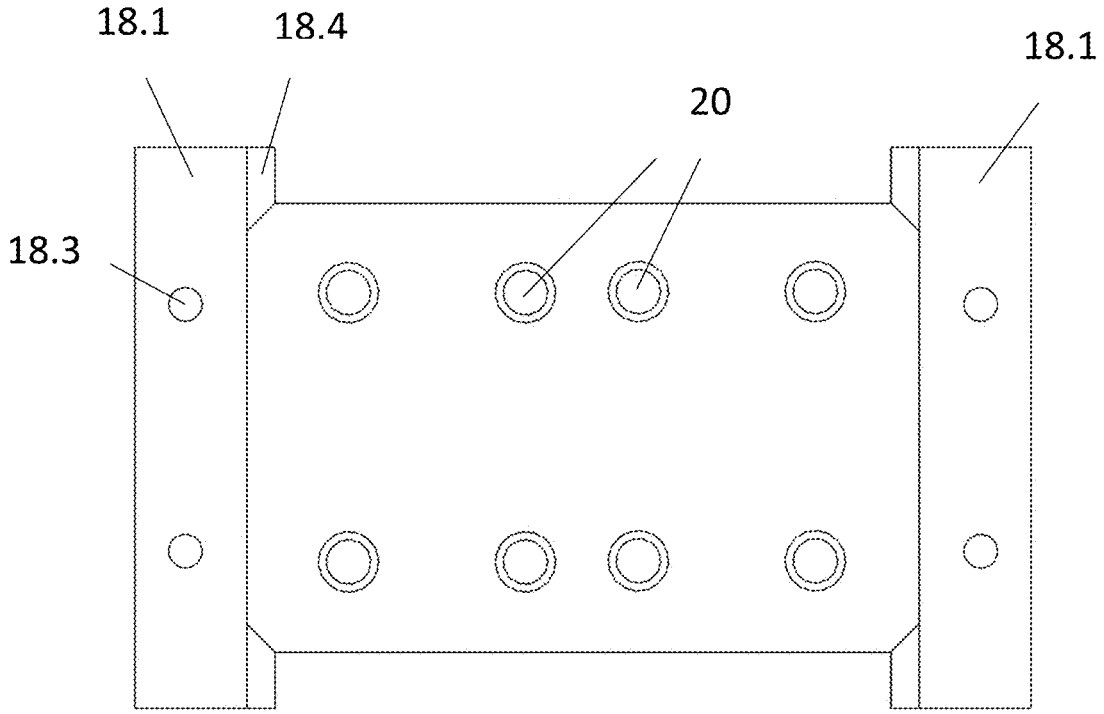
FIG. 10B shows a top plan view of the column unit of FIG. 9.
Figure 10C:
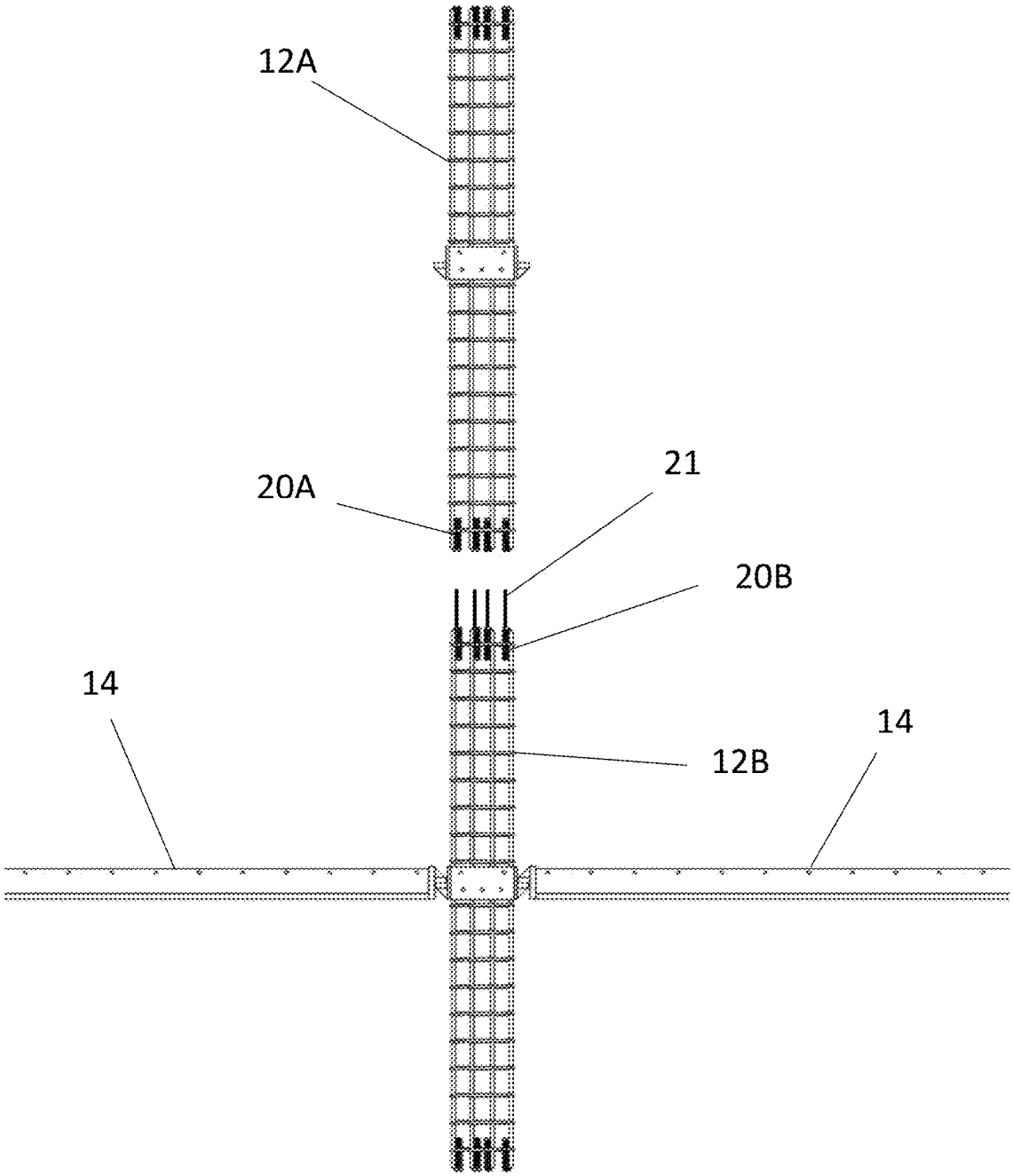
FIGS. 10C and 10D show side views of different assembly stages of placing a first column unit on top of another column unit.
Figure 10D:
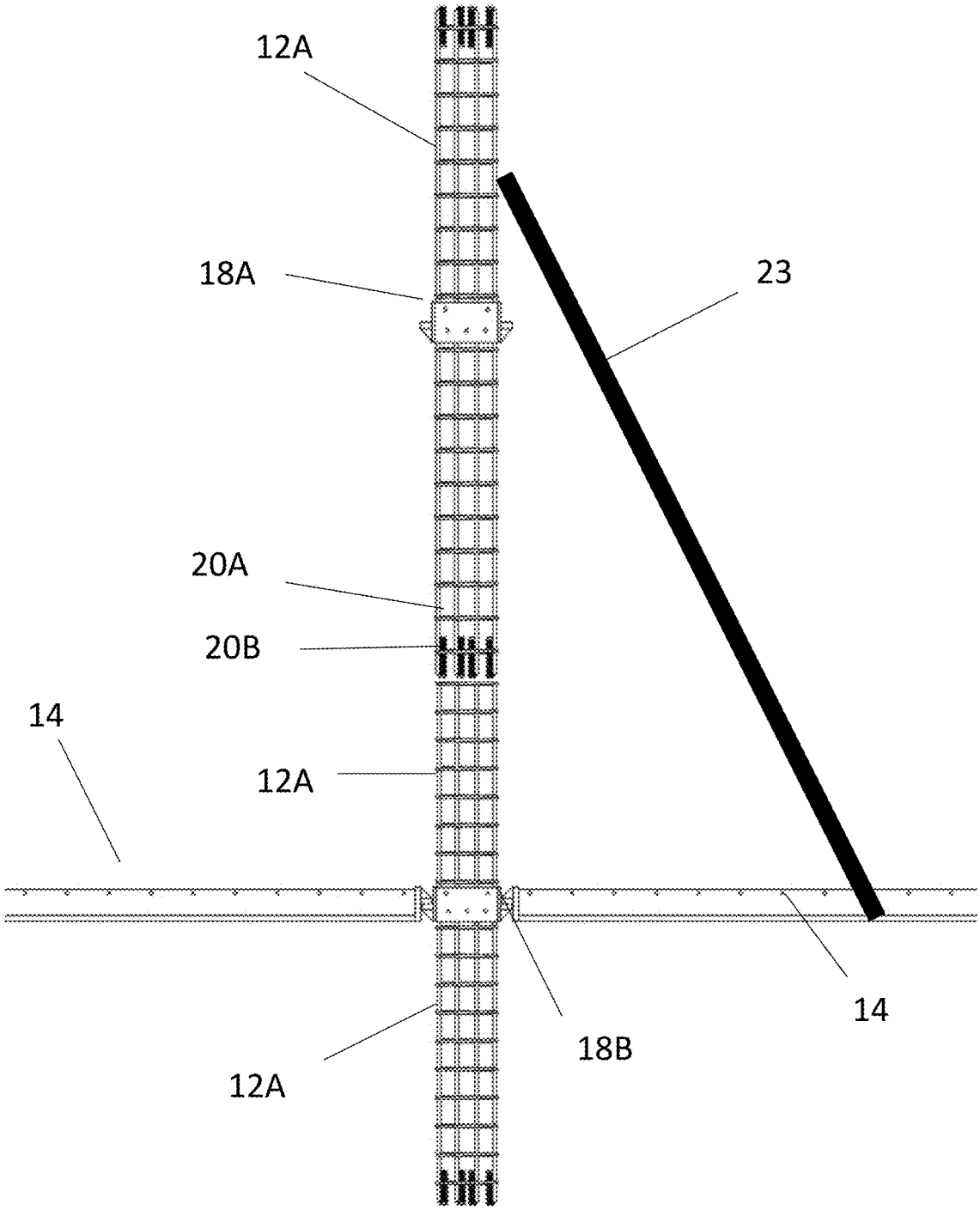

FIGS. 10C and 10D show a first column unit 12A on top of a second column unit 12B during different assembly steps. FIG. 10C shows the column units 12A and 12B in alignment, but prior to being fixated to each other, whereas FIG. 10D shows the column units 12A, 12B during a stage where the grout has been inserted into the grout tubes 20 and is setting.

As shown in FIG. 10C, a top end of the lower column unit 12B has a plurality of bars 21 extending upright from the end of the column unit 12B. The plurality of bars 21 may be attached to the column unit 12B by virtue of grout tubes 20B, similar to grout tubes 20, at the top end of the column unit 12B. The plurality of bars 21 are arranged and dimensioned to fit into the grout tubes 20A at the lower end of the first column unit 12A.

When the first and second column units 12A, 12B are placed on top of one another, the plurality of bars 21 extend into the hollow grout tubes 20A. Subsequently, a charge of high strength grout is delivered down the lengths of the grout tubes 20A. For the delivery of the grout, holes may be drilled through the wall of the first column unit 12A into the grout tubes 20A. Alternatively, the grout tubes 20A may be bent with one end of the grout tubes 20A terminating at a wall portion of the column unit 12A.

By using grout tubes 20A in combination with bars 21, column unit 12A can be secured to the second column unit 12B. It will be appreciated that instead of the plurality of bars 21, both column units 12A, 12B may comprise grout tubes that are in register when the column units 12A, 12B are placed on top of one another. By inserting grout into both grout tubes when aligned, the column units 12A, 12B can be connected. However, an improved stability can be achieved by including the plurality of bars 21 as described above.

Furthermore, it will be appreciated that the plurality of bars 21 may alternatively extend from a lower end of the first column unit 12A to be inserted into grout tubes 20B at the top end of the second column unit 12B.

As shown in FIG. 10D, during the time in which the grout within the grout tubes 20A is setting, the first column unit 12A needs to be supported by a brace 23. The brace 23 may be temporarily attached to the first column unit 12A and a beam unit 14 that is already connected to the column unit 12B by virtue of the bracket 18. In this way, column units can be placed on top of other column units before any deck units are installed. However, it will be appreciated that the brace 23 may alternatively be positioned on a deck unit to support the column unit 12A while the grout is setting.

Figure 14A:
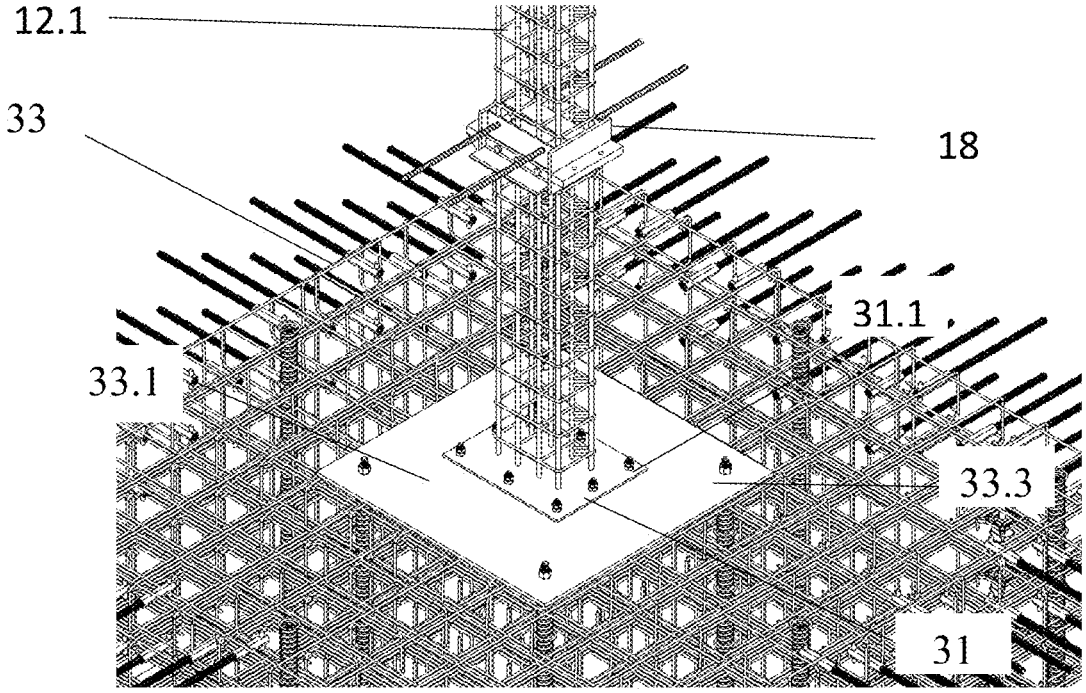
FIGS. 14A and 14B show 3-D views of the column unit 12 attached to a foundation of the building structure 10.
Figure 14B:
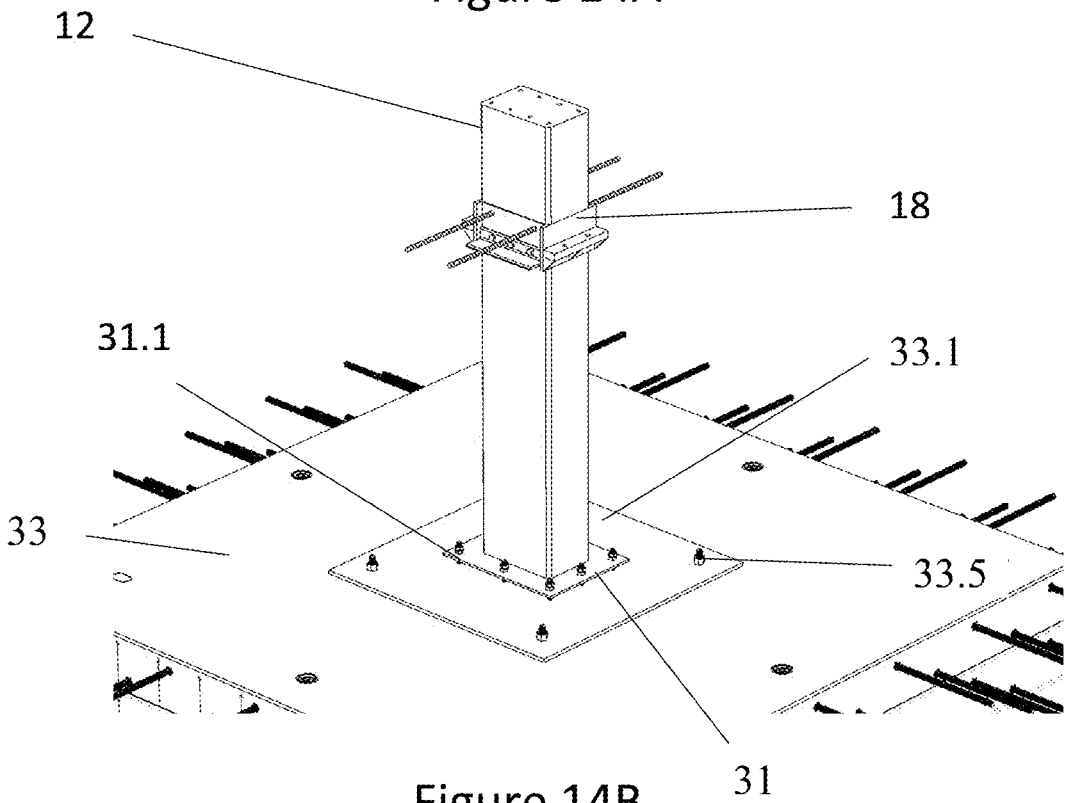

Referring now to FIGS. 14A and 14B, a column unit 12 is shown secured to a foundation of a building structure 10. In particular, FIG. 14A shows a schematic representation of the framework 12.1 of the column unit 12 being secured to a footing 33 that forms part of the foundation of the building structure 10. FIG. 14B shows the finished column unit 12 attached to the footing 33 after the casting process has been completed.

As shown in both FIGS. 14A and 14B, the column unit 12 is mechanically secured to the foundation by virtue of a base plate and a plurality of bolts. In this regard, a column plate 31 is connected to the internal reinforcing framework 12.1. For example, the column plate 31 may be welded to the steel rods 26 of the framework 12.1. The column plate 31 has a plurality of apertures 31.1 for receiving fasteners such as bolts that can be connected to a foundation plate 33.1 of the footing 33. The foundation plate 33.1 may be secured to the footing 33 by virtue of further bolts 33.5. An example of the foundation plate 33.1 and the fixation to the footing 33 is described in detail in Australian provisional patent application No. 2017905037 by the Applicant which is herein incorporated by reference.

It will be appreciated that instead of using the above described mechanical connection, a connection of grout tubes may be used to attach a column unit 12 to the foundation (as described with reference to FIGS. 10A-D). For example, a plurality of bars may protrude upright from the foundation of the building structure 10. The plurality of bars may be arranged and dimensioned to fit into grout tubes 20 of a column unit 12 (as shown in FIG. 10A). Grout may then be injected through holes, preferably at the top portion of the grout tubes 20. In order to substantially seal the grout tubes from the foundation of the building structure 10, a ring of a flexible material may be positioned around each of the protruding bars. When the column unit 12 is placed on the foundation, the flexible rings are compressed thereby substantially sealing the grout within the grout tubes 20.

Figure 15:
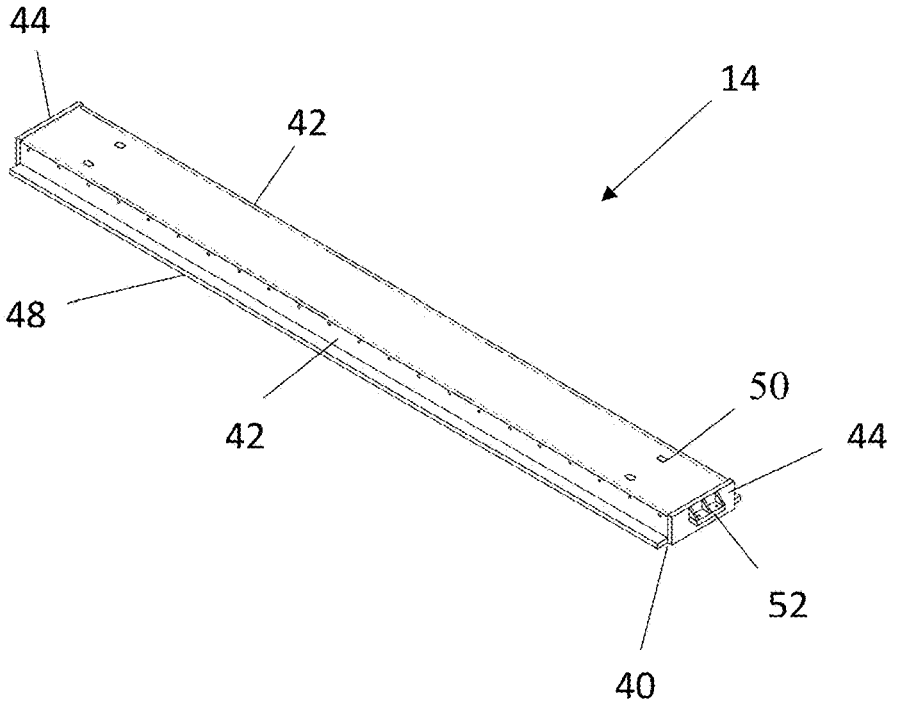
FIG. 15 shows 3-D view of a finished (i.e. including composite material) beam unit of an embodiment of the invention.

FIG. 15 shows a prefabricated structural beam unit 14 in accordance with one embodiment of the invention. The beam unit 14 includes a planar sole 40, two laterally spaced sidewall sections, 42, and two opposed, longitudinally spaced endwall sections 44.

Each endwall section 44 includes one or more structural engagement connectors 52 shaped and dimensioned to engage with, or interlock, under gravity assistance with the complementary structural engagement connectors 18.1 (platforms) of the column units 12 when assembled in situ. The cuboid cavity formed by the sole, sidewall sections and endwall sections is filled with concrete or a cementitious (composite) compound to form an upper surface 46.

Figure 16:
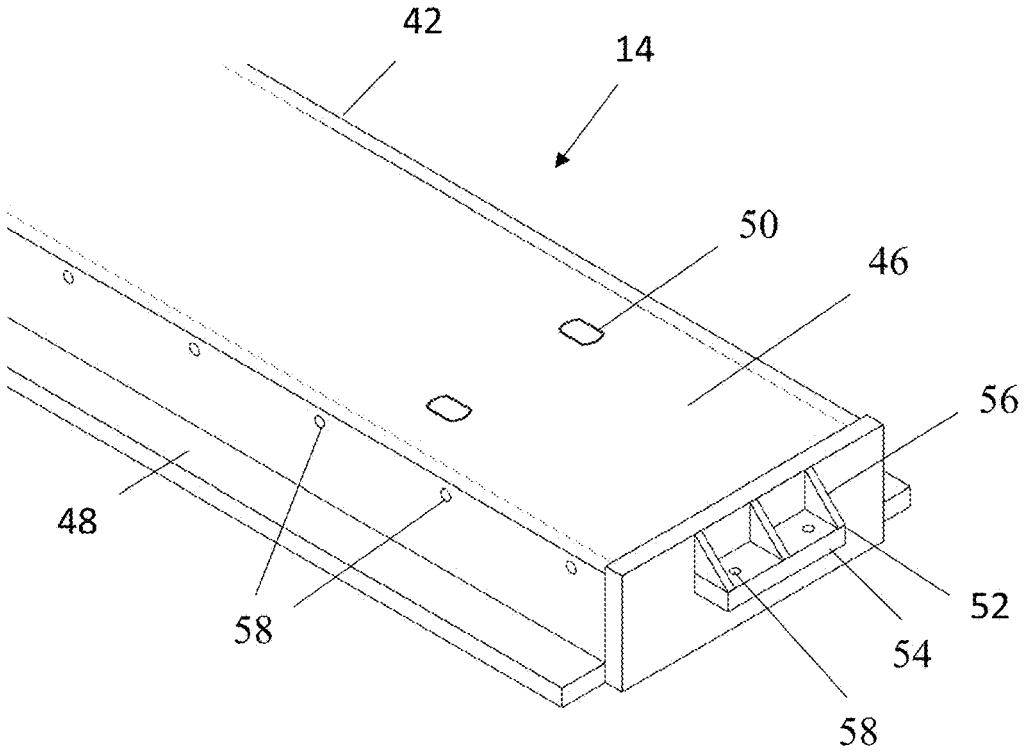
FIG. 16 shows a 3-D view of an endwall of the beam unit of FIG. 15.

With regard to FIG. 16, the structural engagement connectors 52 of one or both endwall sections 44 each are in the form of one or more protrusions extending from the endwall section, typically in the form of one or more cantilevered platforms 55 extending laterally from each endwall section 44.

Each cantilevered platform 54 is supported or reinforced by one or more reinforcement ribs 56 extending downwardly from each endwall section 44.

The platforms 54 each have apertures 58 defined therein for receiving fasteners (best seen in FIG. 21, marked with reference numeral 60), to allow for the beam unit 14 to be fastened securely to the column unit using apertures 18.3.

One or both sidewall sections 42 also include one or more structural engagement connectors shaped and dimensioned to interlock under gravity assistance with a deck unit 16, typically in the form of one or more flanges 48 protruding from the sole 40 and/or sidewall sections 42. The flanges are, in certain embodiments, integral and part of the sole 40, which then extends past the sidewalls 42.

Figure 22:
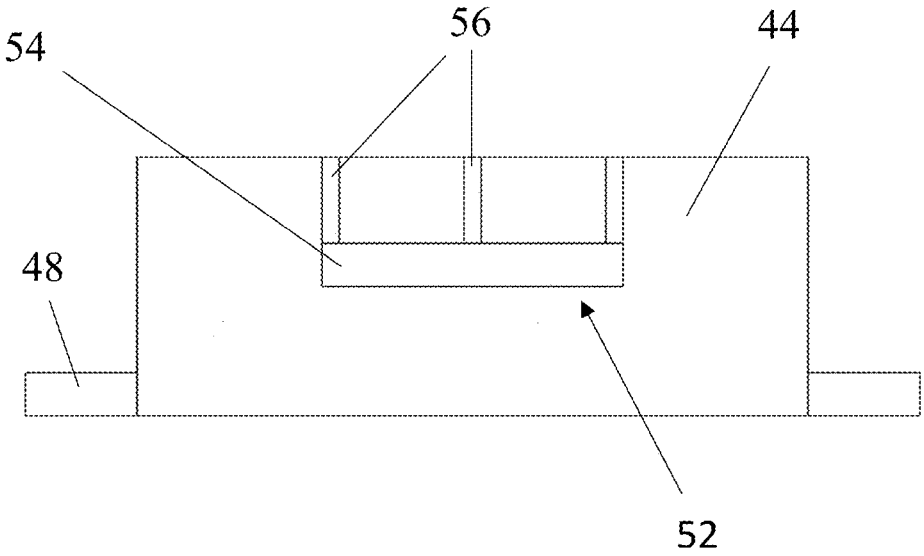
FIG. 22 shows an end view of a regular beam unit according to an embodiment of the invention, having two flanges extending laterally outwardly from the bottom of each sidewall, for supporting deck units on either side of the beam unit.
Figure 23:
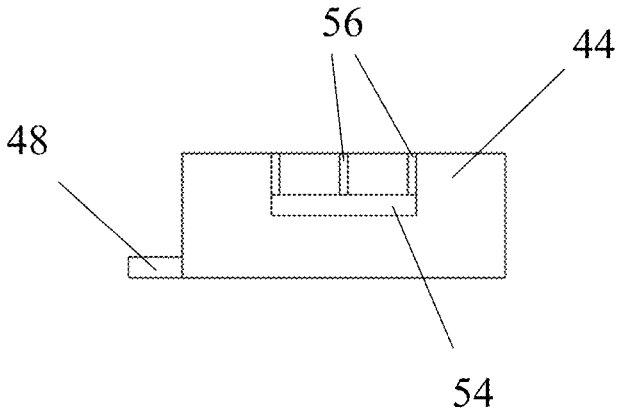
FIG. 23 shows an end view of a terminal beam unit (i.e. a beam unit abutting a wall) according to an embodiment of the invention, having a single flange extending laterally outwardly from the bottom of one sidewall only, for supporting a deck unit on one side of the beam unit only.

The flanges 48 are provided at a height commensurate with an intended deck unit 16 depth, and are shaped and dimensioned to, in use, receive, support, and nest a deck unit 16 in tight proximity, and perpendicular to, the structural beam unit 14. The beam units 14 shown in FIGS. 15 to 18 (and FIG. 22) have flanges 48 extending from each sidewall 42 for receiving deck units 16 on each side thereof, while the beam unit 14 shown in FIG. 23 has only a single flange 48 extending from a single sidewall 42, as this beam unit 14 is a terminal unit which abuts against a wall on the side without the flange 48.

Figure 17:
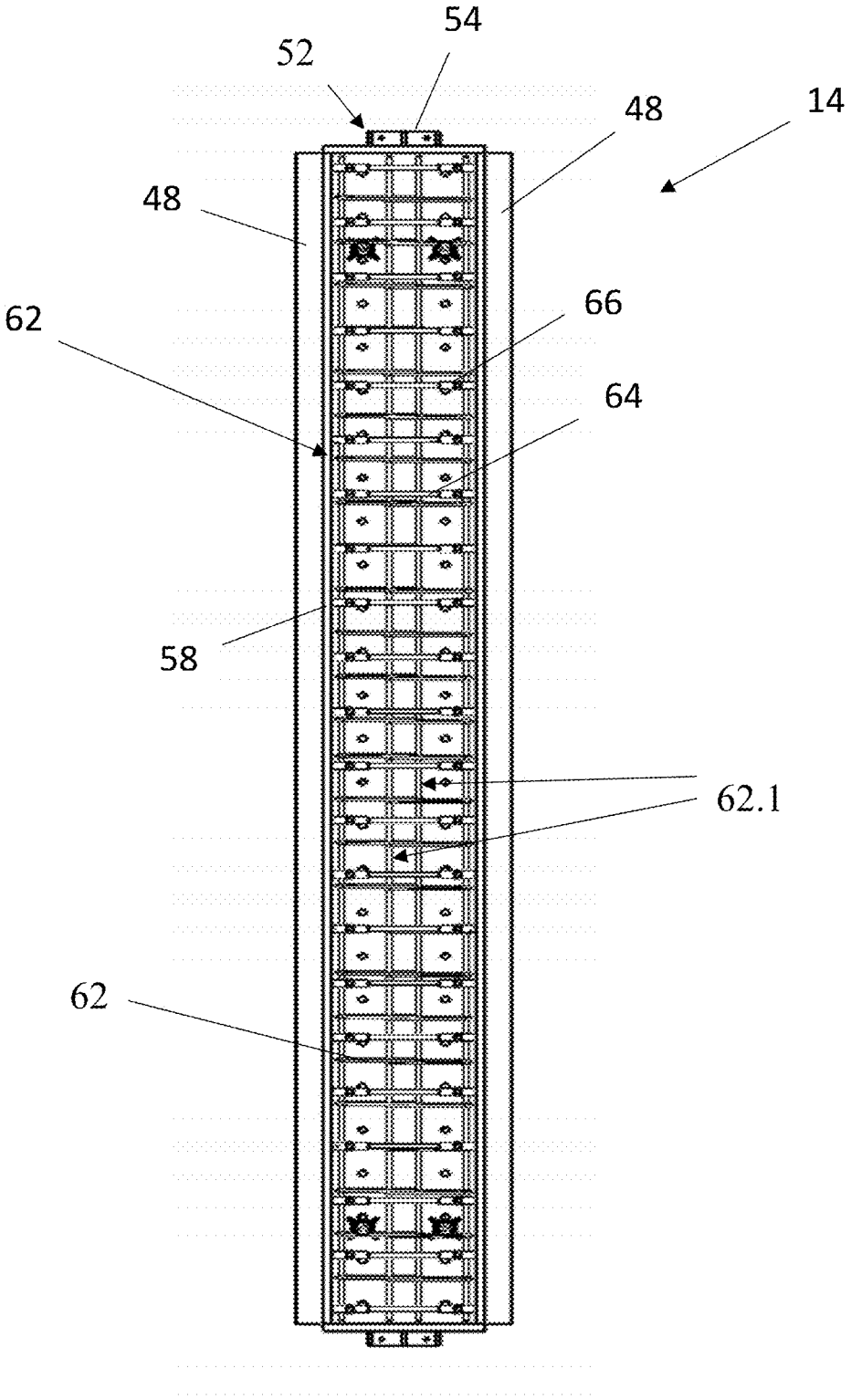
FIG. 17 shows a top plan view of a framework of a beam unit according to an embodiment of the invention.

As shown in FIG. 17, internally, the beam unit 14 includes a reinforcing framework (indicated generally using reference numeral 62). The reinforcing framework 62 includes a plurality of laterally spaced, elongate reinforcing bars 62.1 internal to, and extending substantially the length of, the cuboid cavity defined internally to the beam unit 14. The elongate reinforcing bars 62.1 are interconnected using a plurality of constriction sleeves 62.2, the constriction sleeves 62.2 being in the form of longitudinally spaced bent metal bars extending at least partially around a bundle of reinforcing bars 62.1, best seen in FIG. 18.

Returning to FIG. 17, the reinforcing framework 62 is overlaid with a plurality of elongate shafts in the form of transverse connectors 64 extending between the two sidewall sections 42. The transverse connectors 64 each are in the form of an elongate rod having at least one threaded adjuster 66 (typically in the form of a sleeve which is dimensioned to receive the transverse connectors 64 body) connected thereto to allow for insertion of the transverse connectors 64 between the sidewalls 42. The transverse connectors 64 are locked in place by rotating the threaded adjusters 66 about each transverse connector 64 to urge the, or each, transverse connector 64 into longitudinally spaced apertures (indicated using reference 58 numeral in FIG. 16) defined in, and through, each of the sidewall sections 42. In the embodiment shown, each transverse connector 64 has an adjuster 66 connected at each end thereof (best seen in FIG. 18), i.e. at or proximal the termini of each of the elongate transverse connectors 64, but in one embodiment (not shown) only a single adjuster 66 is provided on each transverse connector 64.

In one embodiment (not illustrated), the reinforcement framework 62 is securely attached to the transverse connectors 64, typically by spot welding. The reinforcement framework 62 is also, in certain embodiments, secured to the endwall sections 44 by welding or additional connectors (not shown).

Depending on the application, the reinforcing framework is attached directly or indirectly (i.e. via intermediary connectors) to the sidewall sections 42 and/or sole 40 at intermittent distances along the lengths of the sidewalls 42 and/or sole 40.

Figure 18:
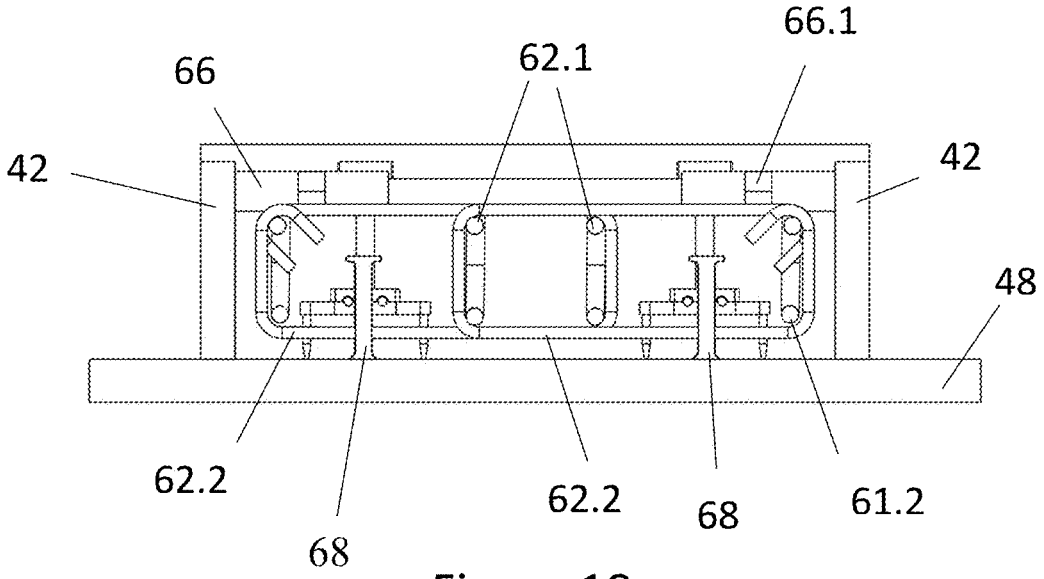
FIG. 18 shows a transverse cross-sectional view (mid-length) of the beam unit framework of FIG. 17.

As may best be seen in FIG. 18, the sole 40 has provided thereupon one or more shear lugs 68, to counter downward deflection of the beam unit 14. The shear lugs 68 are T-shaped to assist with gripping the composite material when the beam unit 14 is charged with the composite material. The shear lugs 68 are welded to the sole 40 and are dimensioned to extend at least partially into an interior cavity defined by the reinforcing framework 62. The above arrangement allows for the beam unit 14 to be much thinner in cross-section, and thus lighter, than conventional prefabricated units of which the Applicant is aware, while still retaining sufficient strength and rigidity.

The adjusters 66 of the transverse connectors 64 each including at least one flanged face, keyed, gripping formation 66.1 to allow for the transverse connectors 64 to be fastened to the sidewall sections 42 by hand or using light manual tools such as wrenches.

The sidewall sections 42 and endwall sections 44 are generally of equal height and the cuboid cavity defined thereby is charged with the composite material up to an upper edge of the sidewalls and endwall sections, 42, 44.

An embodiment of the invention further relates to a formwork module (not shown) for a prefabricated structural beam unit 14, the formwork module including a planar sole, two laterally spaced, elongate sidewall sections; and two longitudinally spaced endwall sections. The sole 40, sidewall sections 42 and endwall 44 sections are arranged to define a cuboid cavity dimensioned to receive the frame work 14.1 of a beam unit 14 and subsequently a charge of composite material in a casting process. In this way, the formwork provides a mould for the beam unit 14. The formwork also includes one or more recesses such that the structural engagement connectors 54 can be accommodated for. The structural engagement connectors 54 are shaped and dimensioned to engage with, or interlock, under gravity assistance with at least one complementary structural engagement connector (i.e. platform 18.1) on the column unit 12.

Figure 19:
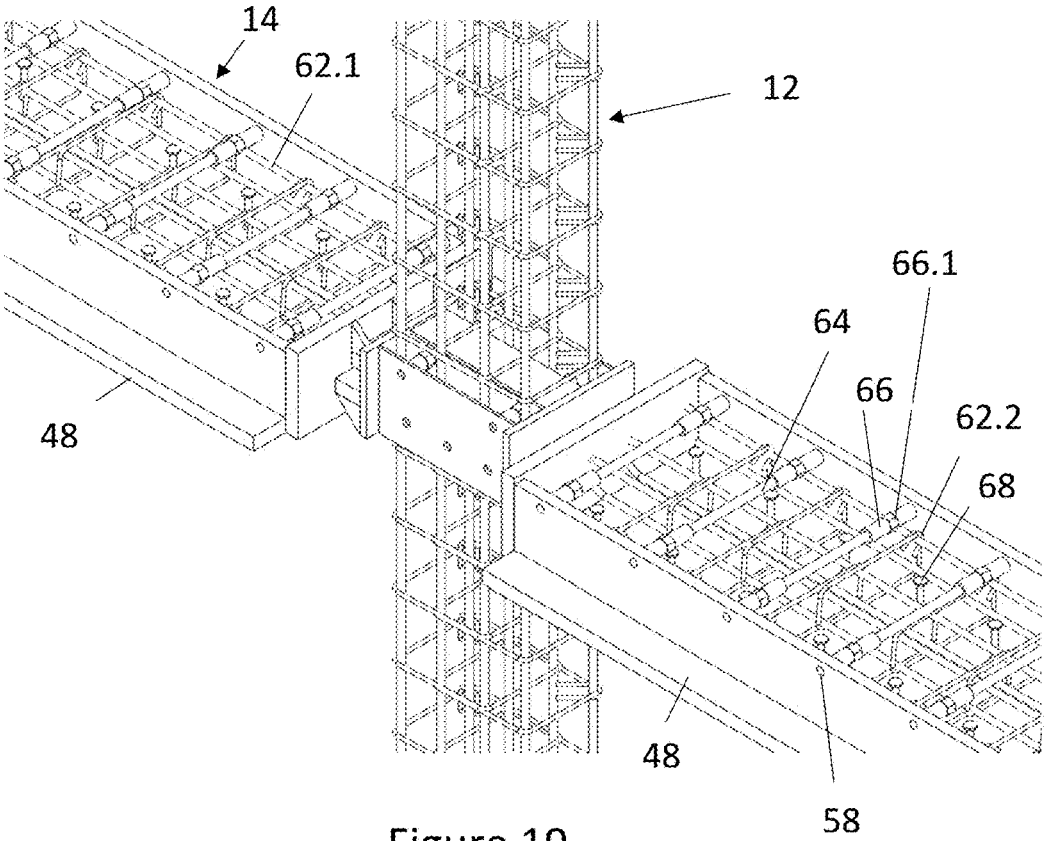
FIG. 19 shows a 3-D view of the framework of a column unit supporting two beam units according to an embodiment of the invention, also shown in framework.
Figure 21:
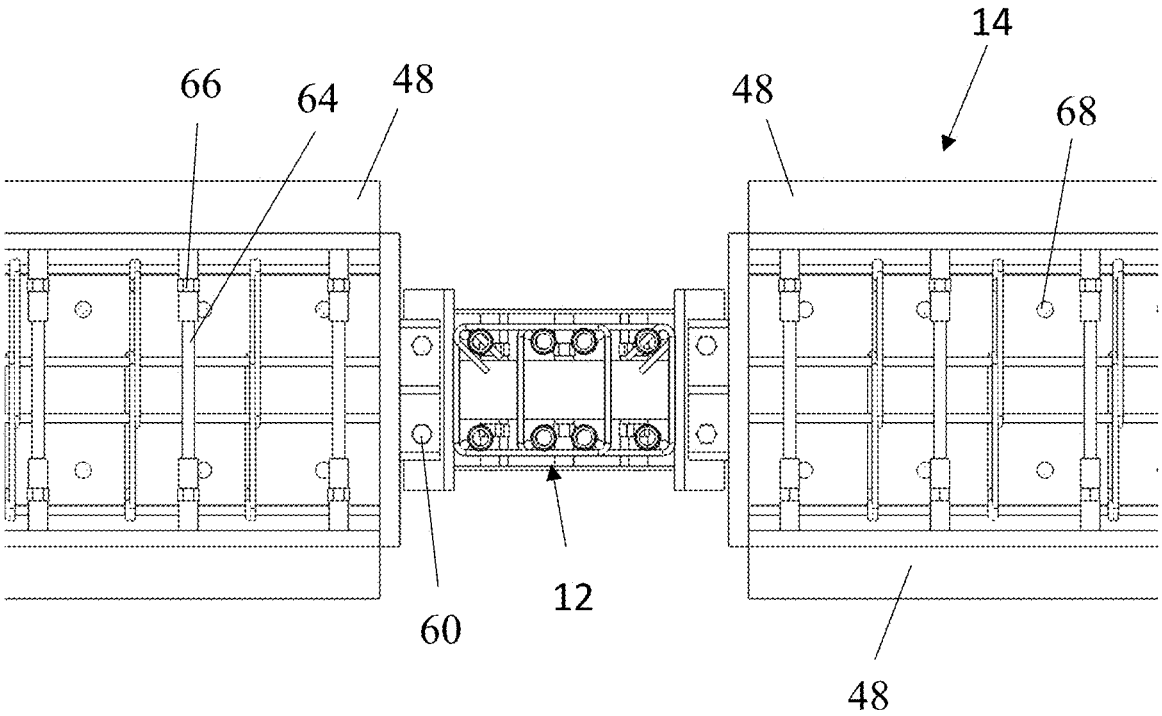
FIG. 21 shows a top plan view of the arrangement of FIG. 19 (i.e. without the flanges attached to the connector plates of the bracket)
Figure 24:
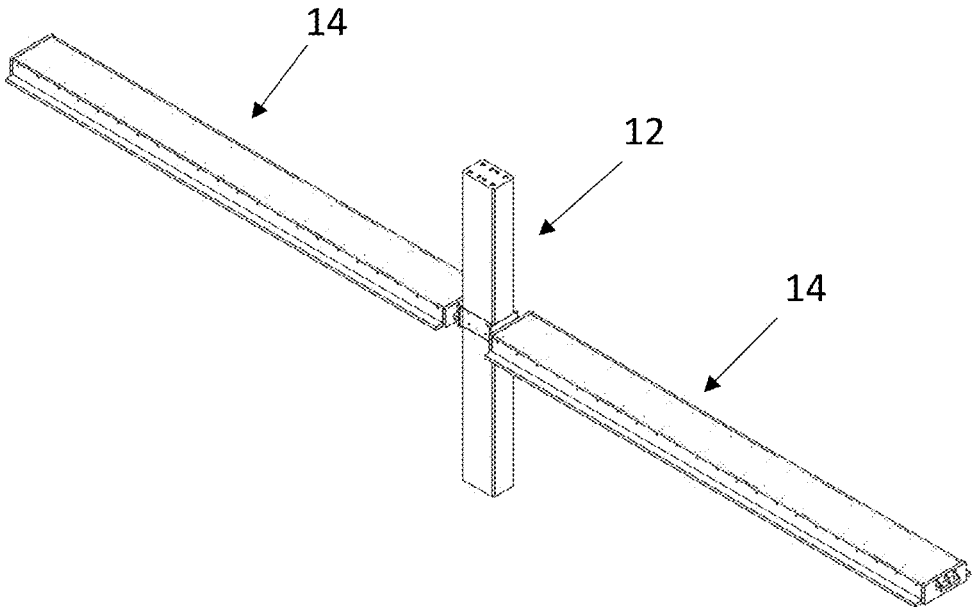
FIG. 24 shows a 3-D view of the framework of a finished prefabricated (i.e. containing composite material) column unit supporting two finished prefabricated beam units.
Figure 25:
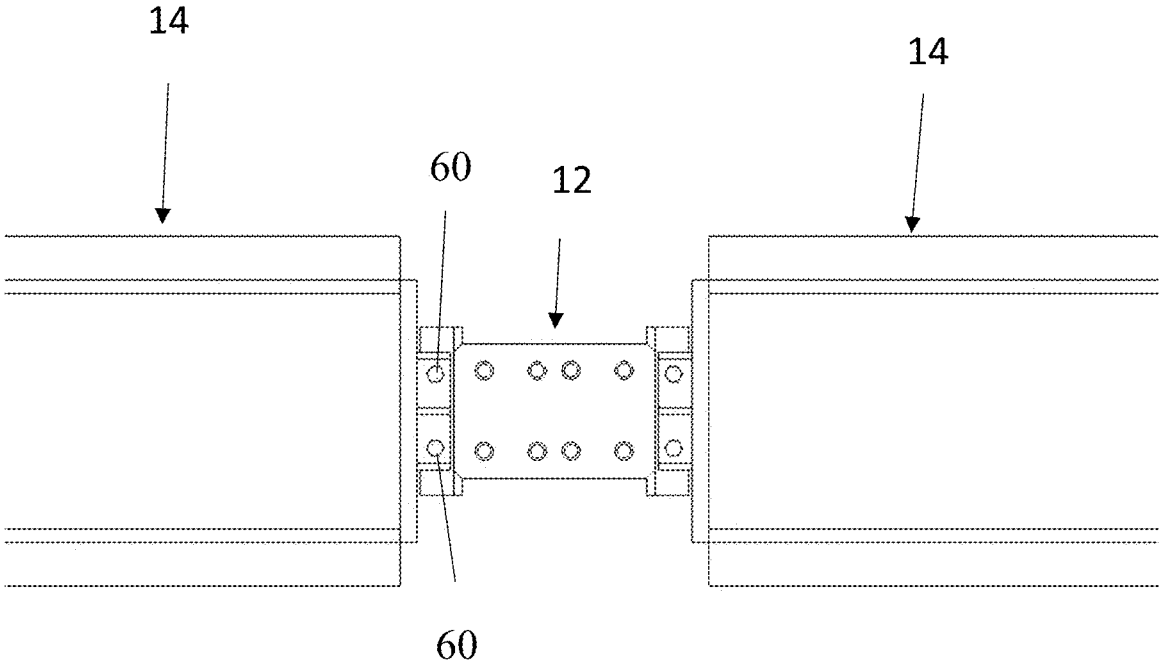
FIG. 25 shows a top plan view of the arrangement of FIG. 24.

FIGS. 19, 20, and 21 show various views in framework view of the beam units 14 resting on, and being supported by, the platforms 18.1 of the column unit 12, by way of the platforms 54 provided on the endwall sections 44 of each beam unit 14. Further views are shown in FIGS. 24 and 25.

Figure 26A:
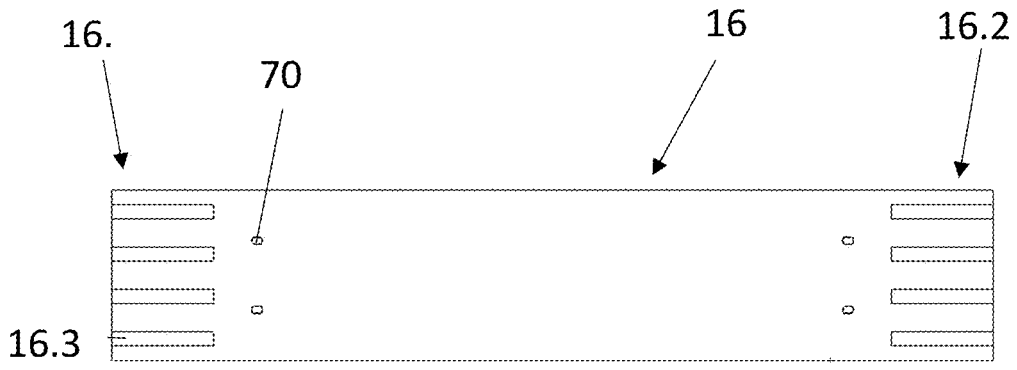
FIG. 26A shows a top plan view of a finished regular deck unit according to an embodiment of the invention.
Figure 26B:
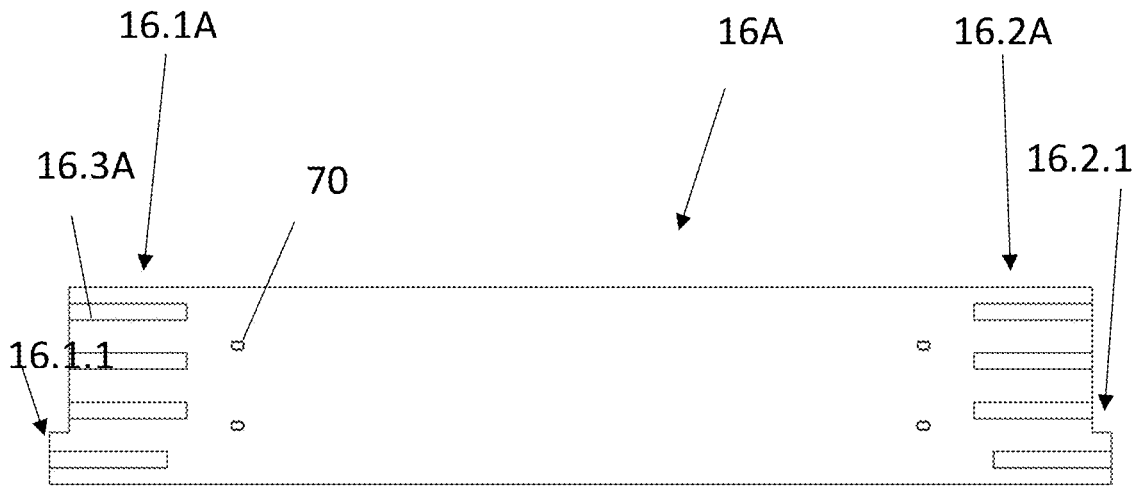
FIG. 26B shows a top plan view of a finished column-abutting deck unit according to an embodiment of the invention, showing a tongue protruding from one end of the deck unit dimensioned to be received snugly on a flange attached to a bracket of a column unit.

Turning now to FIGS. 26A and 26B, there is shown a prefabricated deck unit 16 having opposed ends 16.1 and 16.2. The deck unit of FIG. 26A is a standard deck unit which rests on the flanges 48 provided on the beam units 14. FIG. 26B shows an end-deck unit 16A, i.e. a deck unit that abuts the column 12. This deck unit 16A has ends 16.1A, 16.2A, which include additional extensions in the form of tongues 16.1.1 and 16.2.1 which protrude slightly from the deck unit 16A and are shaped and dimensioned to be received by, and rest, on the flanges (or lower lips) 36 provided on the column units 12. Both deck units 16, 16A also include four cup shaped lifters 70 which are integrally formed during the manufacturing process. Each end 16.1, 16.2 of the deck unit 16 also defines four oblong voids 16.3 that are formed during the casting process using void formers (not shown) and which are used for receiving starter bars 22, as shown in FIGS. 4, 5, and 6. Similarly, the end-deck unit 16A has oblong voids 16.3A at each end 16.1A, 16.2A.

Figure 27A:
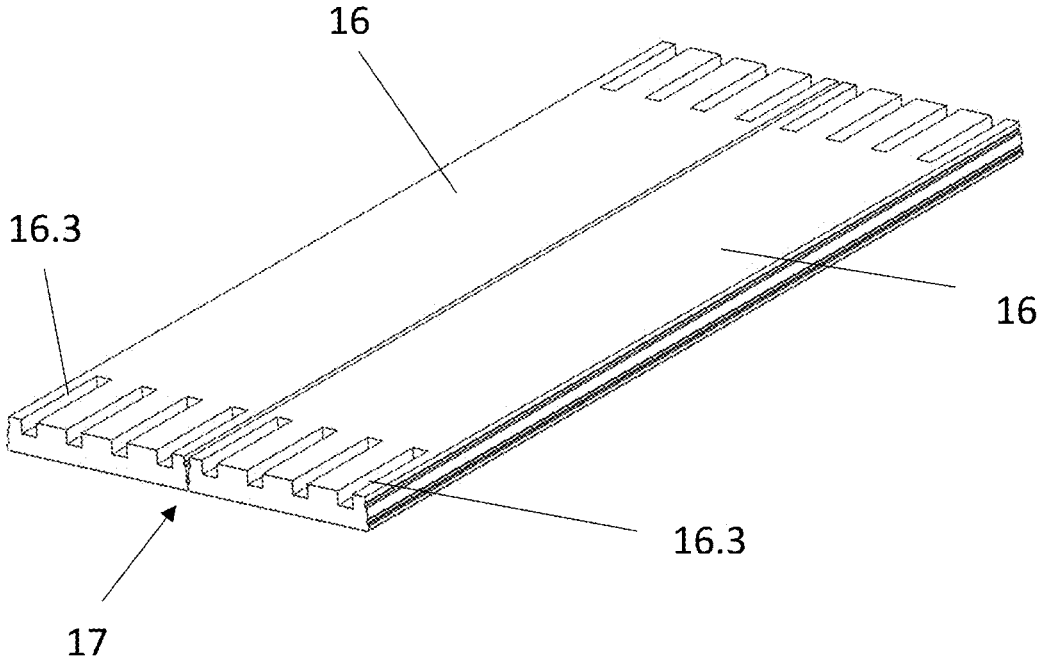
FIGS. 27A and 27B show a 3-D view and an end view of the finished deck unit of FIG. 26A positioned adjacent another deck unit.
Figure 27B:
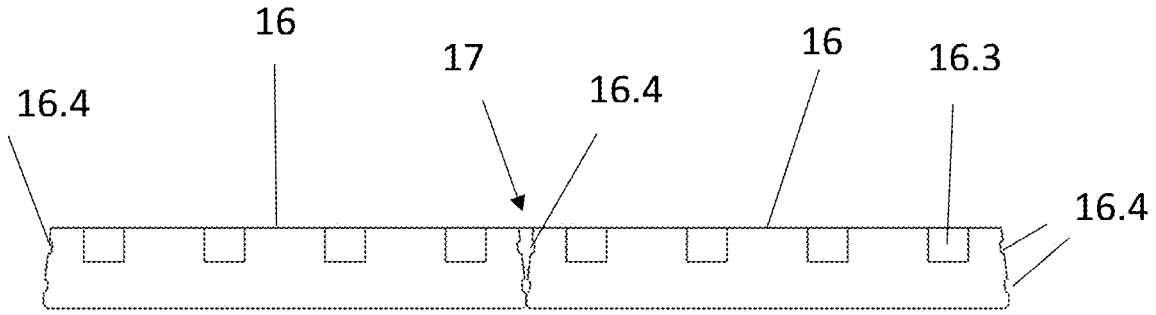

FIGS. 27A and 27B shows two finished regular deck units 16 positioned adjacent to each other. By placing deck units 16 next to each other as shown in the Figures, the deck extending over a desired area can be installed. In order to connect adjacent deck units 16 with each other, each deck unit 16 includes tapering side walls such that a V-shaped recess 17 is created between adjacent deck units 16. This V-shaped recess 17 is typically filled with a composite material such as grout to secure the two deck units 16 to each other.

Each deck unit 16 further comprises one or more grooves 16.4 within each sidewall. In this example, both deck units 16 have two grooves 16.4 extending along the opposite sidewalls. The grooves 16.4 improve the connection between the two deck units 16 when the composite material is inserted into the V-shaped recess 17. In this way, the deck units 16 can be locked next to each other not only horizontally but also vertically.

Figure 28A:
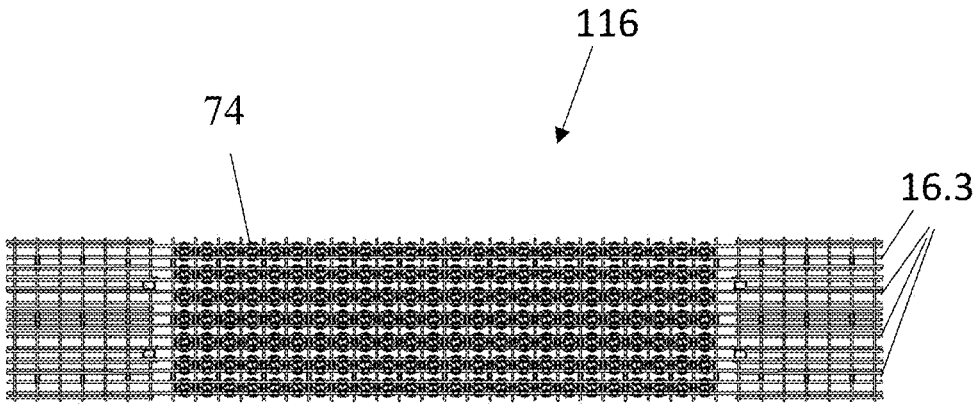
FIG. 28A shows a top plan view of a framework of a regular deck unit.
Figure 28B:
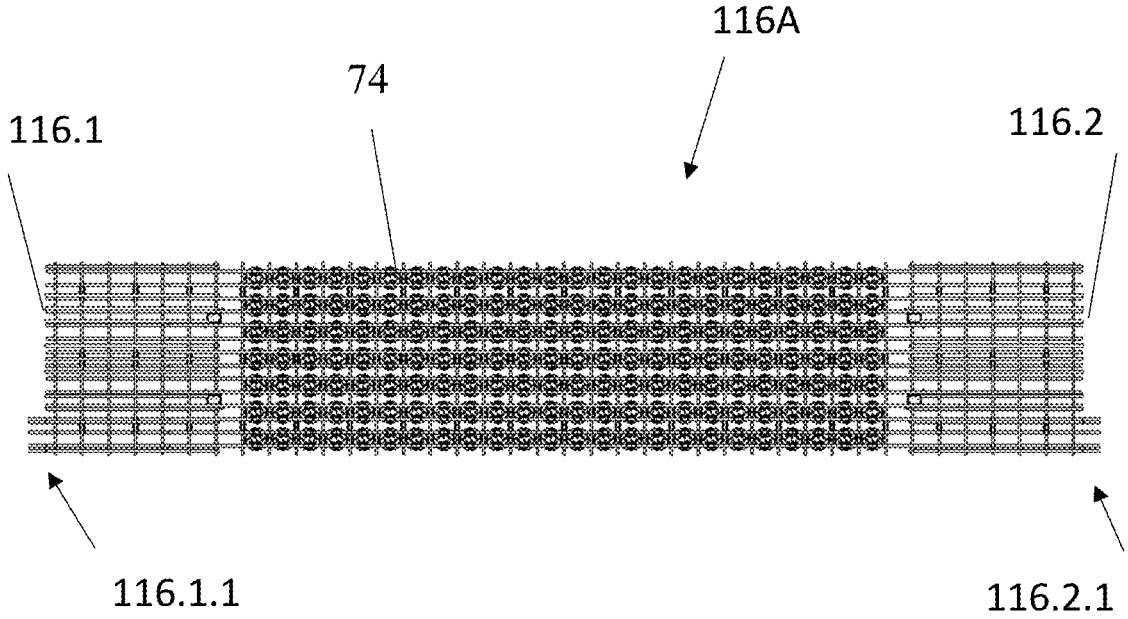
FIG. 28B shows a top plan view of a framework of a column-abutting deck unit.
Figure 29:
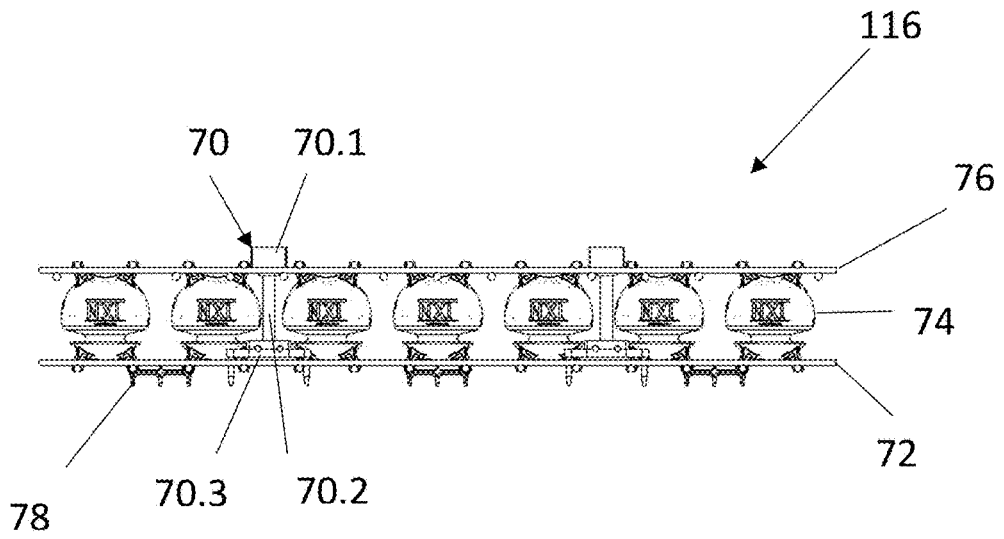
FIG. 29 shows an end view of a framework of a regular deck unit, showing the spheroidal void formers according to an embodiment of the invention between two framework mesh units.

FIG. 28A shows an internal reinforcing framework 116 for a regular deck unit 16, while FIG. 28B shows an internal framework 116A for an extended deck unit 16A with extended tongues 116.1.1 and 116.1.2 formed by the extended reinforcing framework 116A.

In the following, an exemplary configuration of a standard deck unit 16 will be described. However, a person skilled in the art will appreciate that similar considerations apply to an end-deck unit 16A. During manufacturing the reinforcing framework 116 is encased in a composite material using suitable formwork to define the outer edges, bottom, and voids in the finished prefabricated deck unit 16. The reinforcing framework 116 comprises a first, operatively lower, metal mesh unit 72 with regularly shaped interstices defined therein, a plurality of interspaced spheroidal void formers 74 attached to or in intimate contact with the lower mesh unit 72, and a second, operatively upper mesh unit 76 (with similar interstices in register with those of the lower mesh unit 72) resting upon, or attached to, the spheroidal void formers 74, the combined reinforcing framework 116 defining four terminal channels 16.3 at each end 16.1, 16.2 of the deck unit 16, each terminal channel 16.3 being shaped and dimensioned to snugly receive an elongate connecting (or starter) rod 22 for connecting the deck unit 16 to a beam unit 14 during assembly in situ.

As shown in FIGS. 29 to 33, the spheroidal void formers 74 each comprise a generally spheroidal body 74.1 that has a cinched waist 74.6, typically below a midline of the spheroidal body 74.1. The cinched waist 74.6 of the spheroidal body 74.1 defines a radially extending interstitial gap 74.2, in turning defining an operatively lower lip 74.3 that serves as a circumferentially extending seat for receiving the composite material. The provision of the cinched area 74.6 in the body 74.1 lessens the probability of the spheroidal void formers 74 floating when a composite material is added to the reinforcing framework 116. It also increases purchase of the composite material on the spheroidal void formers 74 and urges the spheroidal void formers 74 downwardly when the composite material is poured during casting of the deck unit 16.

Figure 31:
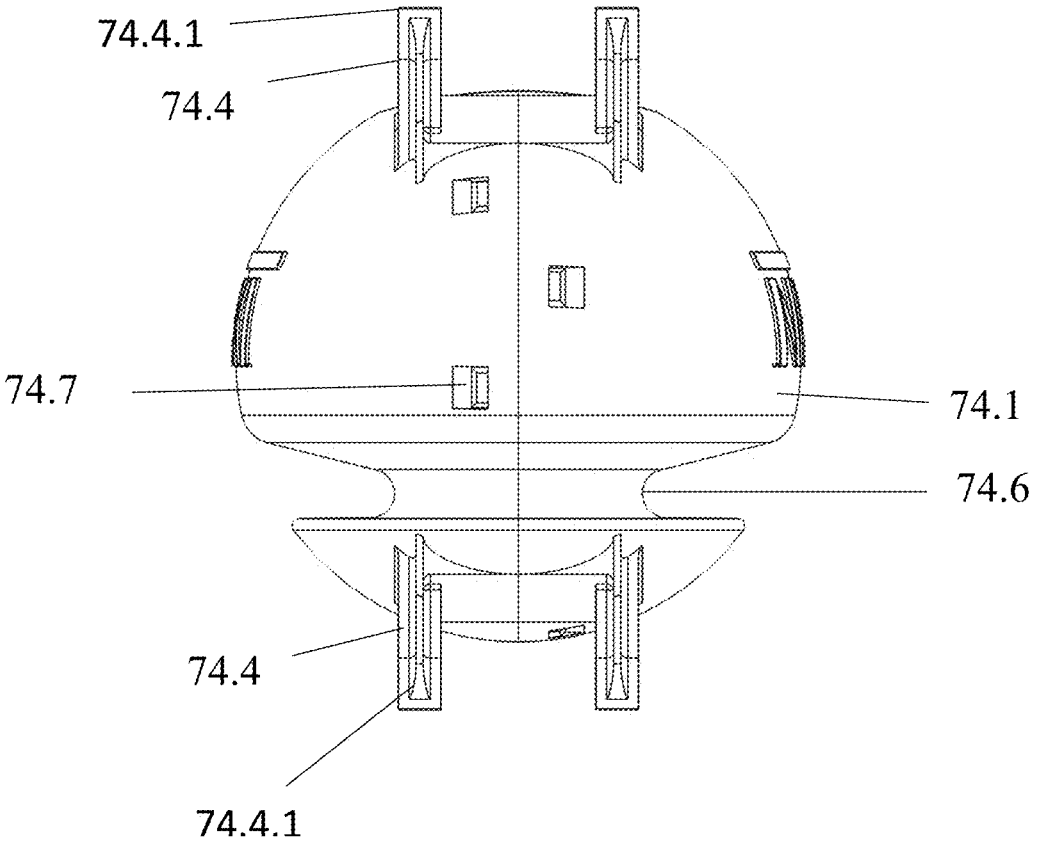
FIG. 31 shows an end view of a spheroidal void former.
Figure 32:
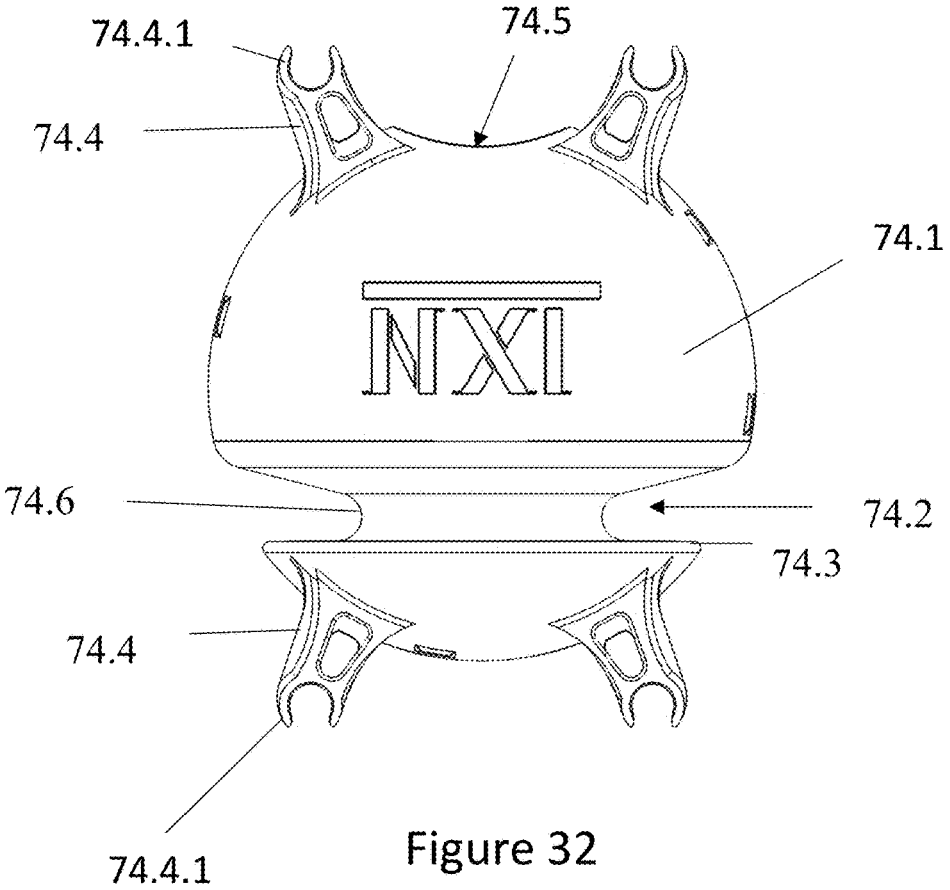
FIG. 32 shows a side view of a spheroidal void former.
Figure 33:
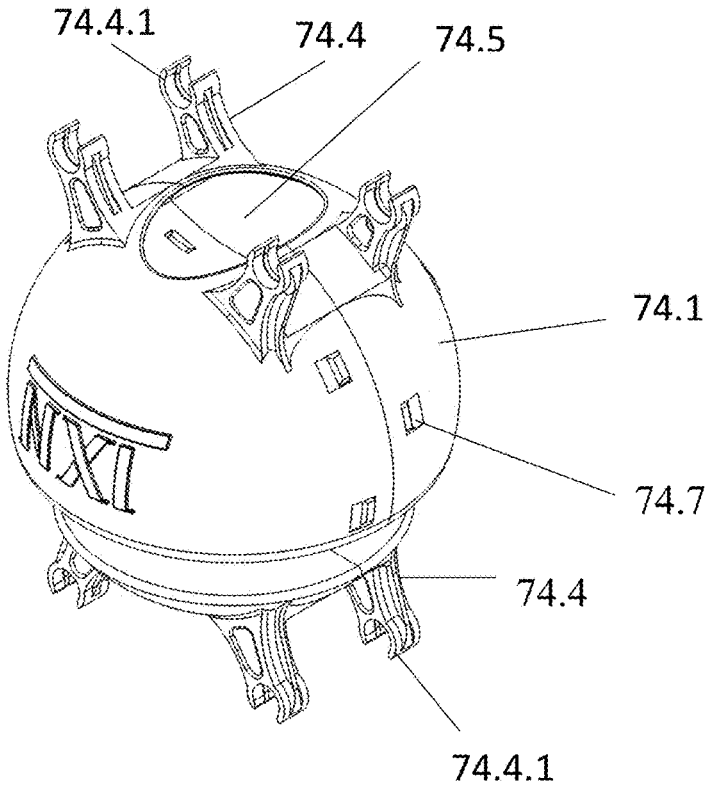
FIG. 33 shows a 3-D top view of a spheroidal void former.

As seen in FIGS. 31 to 33, each spheroidal body 74.1 further includes two or more radially spaced arms 74.4, each arm being provided with a distal connector 74.4.1 for connecting the void former 74 to the reinforcing framework 116. The connector 74.4.1 on each arm 74.4 is shaped and dimensioned to attach or connect in a friction, slight interference, or snap fit manner with the lower mesh 72, upper mesh 76, or rebar or other reinforcing elements that may be present in the reinforcing framework 116.

The arms 74.4 and connectors 74.4.1 are integrally formed with the spheroidal body 74.1. The spheroidal body 74.1 further has an indented crown 74.5 provided atop the body 74.1, the indented crown 74.5 being shaped and dimensioned to entrap a charge of the composite material (not shown) to further assist in bedding down the spheroidal void former 74 and to increase purchase of the composite material on the spheroidal void former 74.

The spheroidal body 74.1 is manufactured in bisected mirror-fashion with interlocking lugs 74.7, allowing a single mould to be used to manufacture two interlocking halves of the spheroidal body 74.1 and allowing for the halves of the spheroidal body 74.1 to be transported in nested fashion and rapidly assembled on site.

Figure 30:
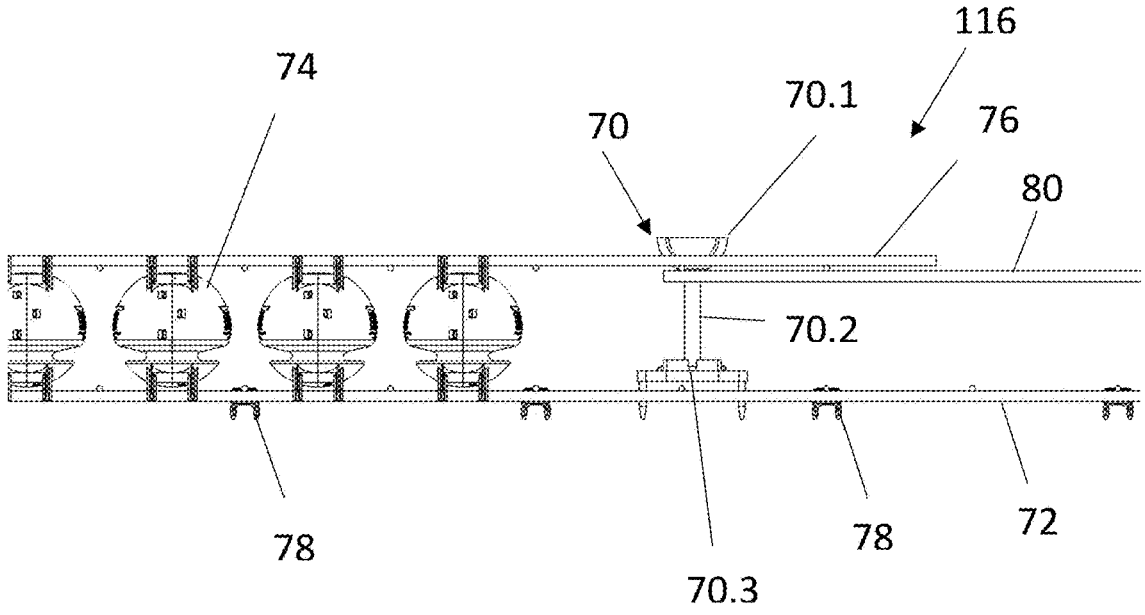
FIG. 30 shows a section of a side view of a framework of a regular deck unit, showing not only the spheroidal void formers, but also details of a lifting formation for lifting the deck unit once formed.
Figure 35:
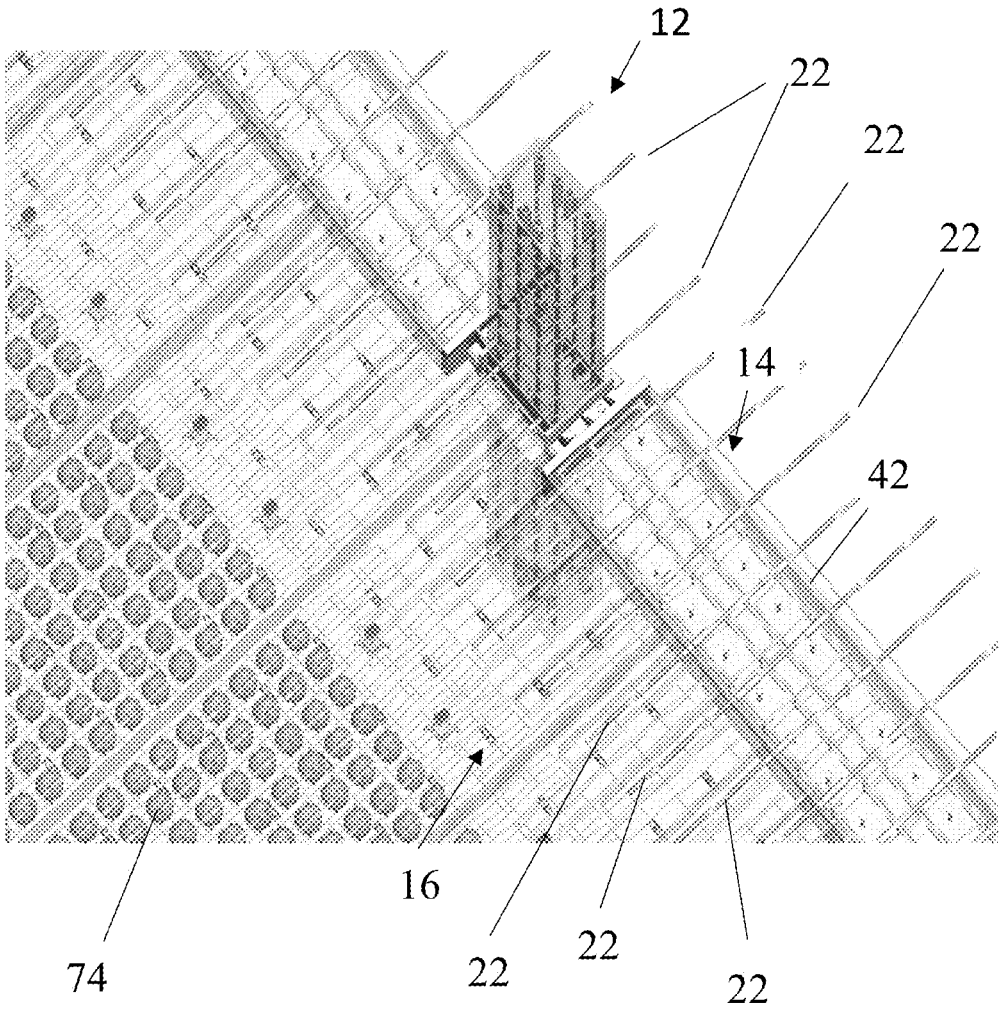
FIG. 35 shows a 3-D view of details of the attachment of the deck units to the beam units.

As may best be seen in FIG. 30, The reinforcing framework 116 further includes lifters 70 in the form of semi-circular attachment formations 70.1 connected to stanchion 70.2 that, in turn, is connected to a plinth 70.3. The lifter 70 not only serves to allow for the attachment of hoisting equipment (not shown) to the deck unit 16, but also serves to bind the upper 76 and lower 72 mesh units to one another. FIG. 30 also shows an end mesh unit which is attached to each end 16.1, 16.2 (only one end is shown in FIG. 30) of the deck unit 16 which is in the form of a further mesh unit for receiving the oblong void formers mentioned above (not shown) to form oblong voids 16.3 for receiving starter bars 22 during assembly in situ, and as shown in FIG. 35, which shows starter rods emanating from (and in some instances, passing through) each sidewall of beam unit 14 as well as emanating from (and in some instance, passing through) column unit 12.

As mentioned above, the deck unit 16 is typically cast using a formwork mould. Specifically, during manufacturing of the deck unit 16, the lower reinforcing mesh 72 may be positioned in a formwork mould (not shown) by resting on a series of elevating spacer chairs 78 that serve to elevate the reinforcing framework 116 from a lower surface of the formwork mould (not shown). The formwork mould typically is in the form of a steel bed. However, other suitable formwork moulds are envisaged. The plurality of void formers 74 are then positioned on and attached to the lower reinforcing mesh 72 by virtue of the arms 74.4. The upper reinforcing mesh 76 can then be positioned on top of the plurality of void formers 74 and attached to them by virtue of the arms 74.4. Composite material is then poured into the formwork mould to cast the deck unit 16.

The composite material generally is concrete, grout, mortar or any other cementitious material. In a preferred embodiment, the composite material used to form the column unit, beam unit, and deck unit is 40 mPa concrete.

Figure 34A:
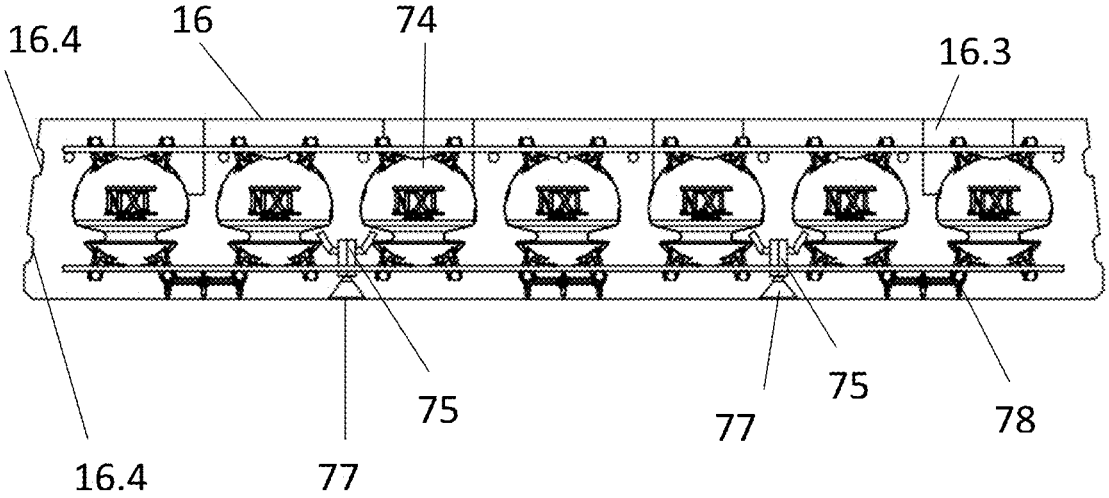
FIGS. 34A and 34B show an end view and a top view of the deck unit of FIG. 26A, including a plurality of ferrules.
Figure 34B:
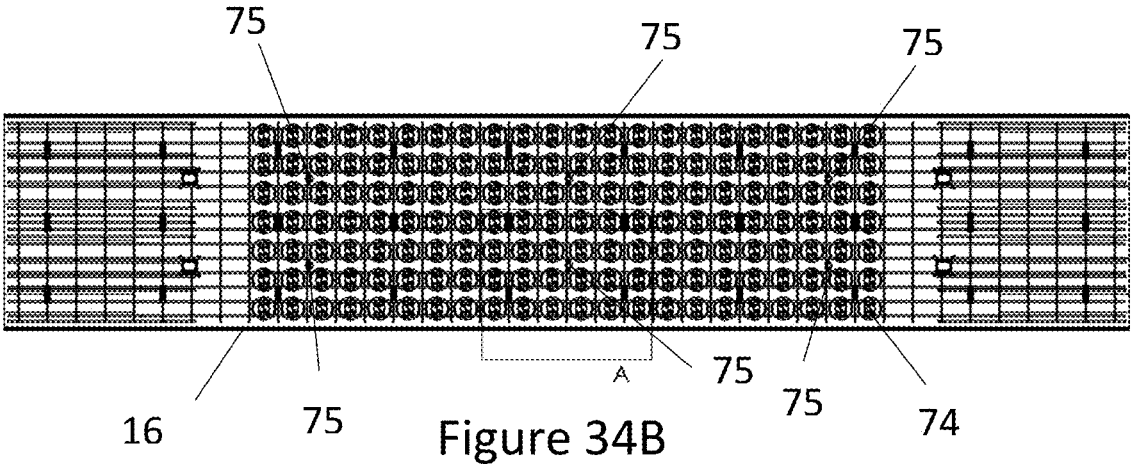
Figure 34C:
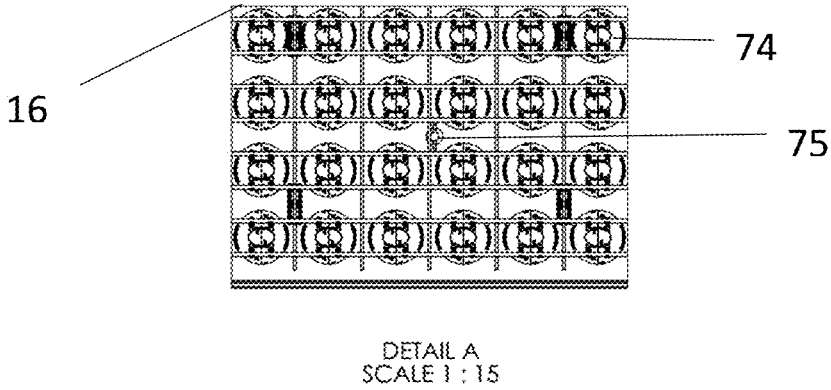
FIG. 34C shows an enlargement of the rectangular portion A of FIG. 34B, to illustrate the details thereof.

In one particular example as shown in FIGS. 34A and 34B, with details of the rectangular portion A of FIG. 34B being shown in the enlarged view thereof in FIG. 34C, one or more ferrules 75 are attached to the lower reinforcing mesh 72. In the example shown in FIG. 34B, 6 ferrules 75 are attached to the lower reinforcing mesh 72 in a symmetrical pattern relative to the shape of the deck unit 16. However, a person skilled in the art will appreciate that any numbers of ferrules 75 may be incorporated within the deck unit 16. For example, 4 or 8 ferrules may be attached in a symmetrical pattern.

The ferrules 75 are attachable to respective magnets 77 which may or may not be removed after the deck unit 16 has been cast. The magnets 77 have the function of holding the lower reinforcing mesh 72 attached to the steel bed (not shown) of the formwork mould when the composite material is being poured.

One problem of casting the deck unit 16 including void formers 74 has been that the void formers 74 may float and move towards an upper surface of the deck unit 16. This problem can be avoided or at least reduced by using the magnets 77 attached to the ferrules 75 between the steel bed and the lower reinforcing mesh 72.

Furthermore, the Applicant has discovered that by pouring the composite material directly from above from a central position relative to the deck unit 16, floating of the void formers 74 can further be reduced.

Figure 36:
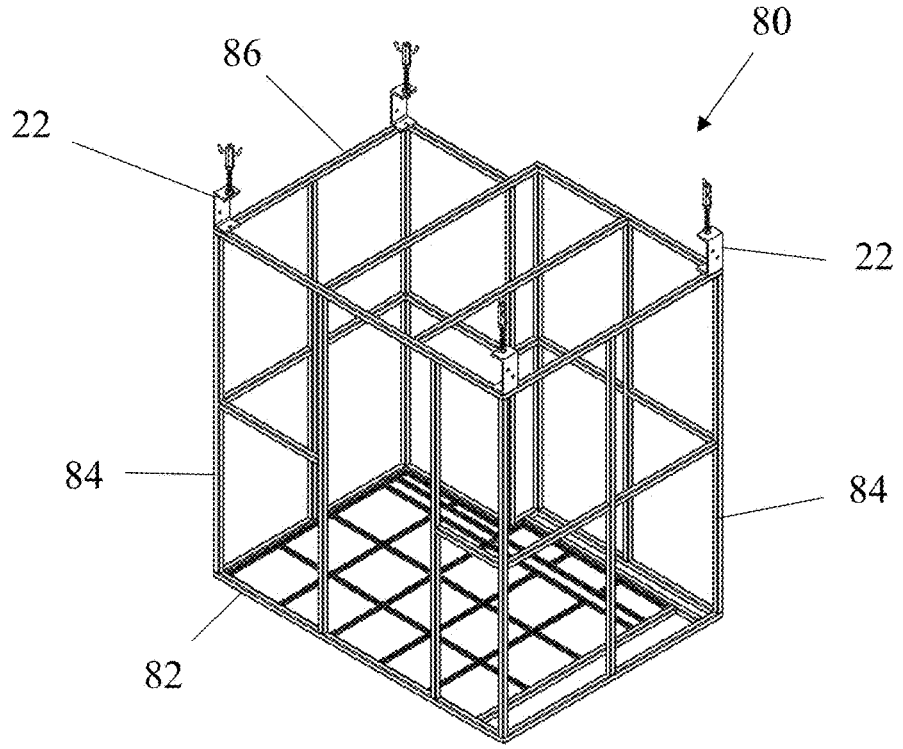
FIG. 36 shows a 3-D view of a pod unit according to an embodiment of the invention, in this case a bathroom pod.

FIG. 36 shows a further prefabricated unit according to an embodiment of the invention, in the form of a pod unit 80, in this embodiment a bathroom pod. A finished bathroom pod typically includes plumbing, a basin, cistern, toilet bowl, and may include wiring if required (not shown). Referring back to FIG. 36, the pod unit 80 includes a 3-dimensional frame structure 80.1 defining an outer perimeter of the pod unit 80, the frame structure 80.1 having a lower base frame 82, at least four uprights 84 (in this case eleven uprights) extending upwardly from the lower base frame 82, and a circumferentially extending upper frame 86 connected to the uprights 84. The upper frame 86 has attached thereto laterally spaced adjustment connectors 88, best shown in FIGS. 37, 38, and 39. Each each adjustment connector 88 is in the form of a C-shaped bracket 88.1 having an upper connecting end 88.2 for connecting to one or more prefabricated units of a building structure, such as a deck unit 16, and a lower connecting end 88.3 connected to the upper frame 86. The adjustment connector 88 comprises a vertical adjustor 90 extending between the upper connecting end 88.2 of the C-shaped bracket 88.1 and the lower connecting end 88.3 thereof.

Figure 38:
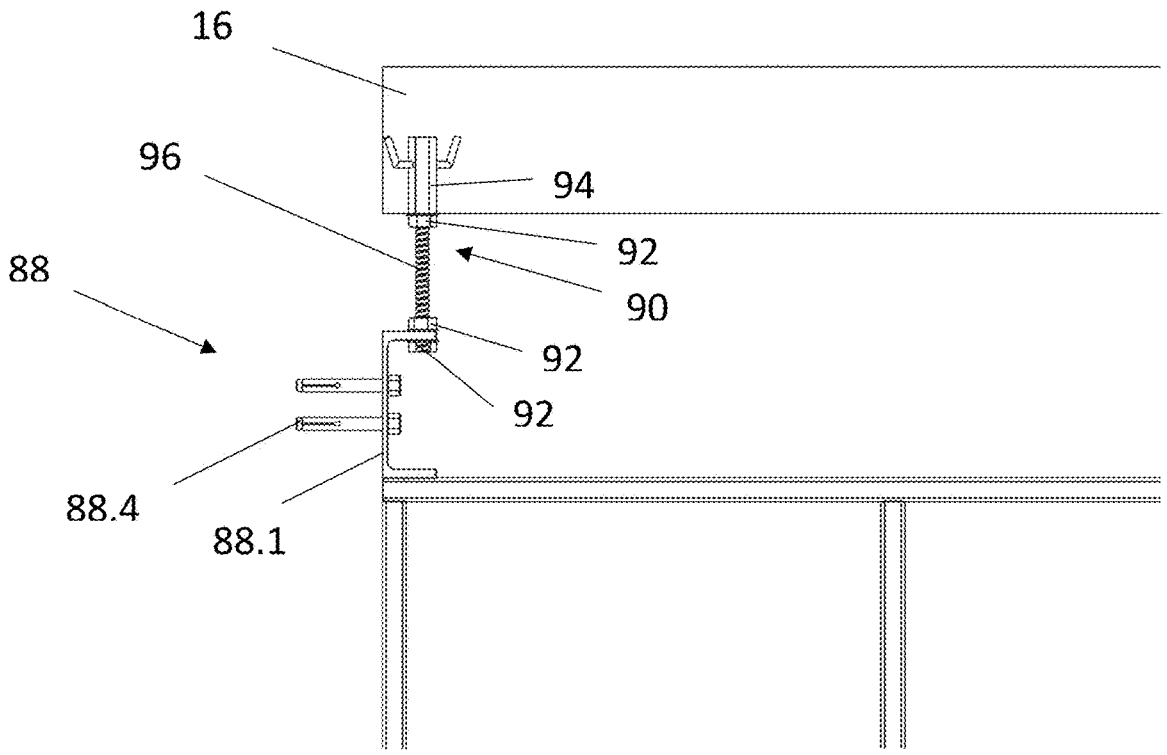
FIG. 38 shows a side view of the bracket of FIG. 37.
Figure 39:
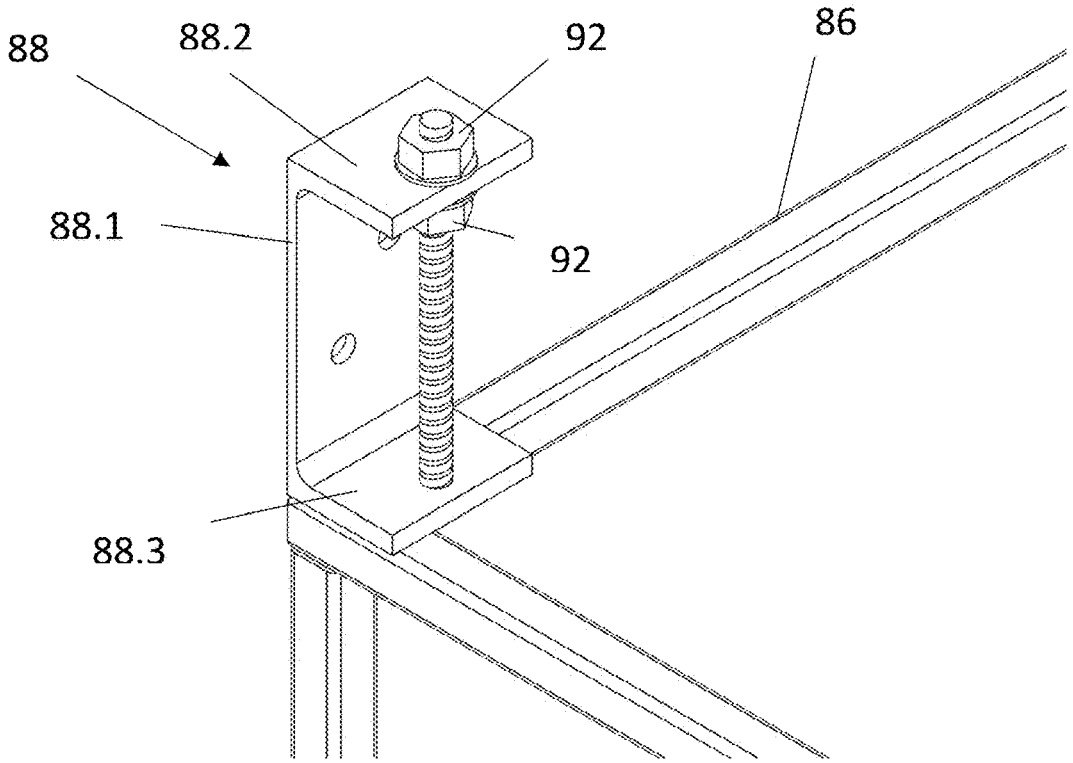
FIG. 39 shows a 3-D view showing greater detail of the suspension and leveling bracket of FIG. 37.

In this example, the vertical adjustor 90 is in the form of one or more adjustment nuts 92 that are threadedly mounted on an adjustment strut in the form of a threaded bolt 96 extending between the upper connecting end 88.2 of the C-shaped bracket 88.1 and the lower connecting end 88.3 thereof (see in particular FIG. 39). The threaded bolt 96 is initially positioned within the C-shaped bracket 88.1 (see FIG. 39) and can be moved relative to the C-shaped bracket 88.1 to attach to a ferrule 94 that is part of the deck unit 16 (see FIG. 38).

Specifically, the ferrule in this example is in the form of a threaded wingnut formation 94 which has been cast into the deck unit 16. When the threaded bolt 96 is attached to the ferrule 94, the length of the threaded bolt 96 can be adjusted by using the adjustment nuts 92. In this way, the height and level of the unit pod 80 relative to the deck unit 16 can be adjusted, once the pod is attached to the underside of the deck unit 16, when in situ, the threaded bolt 96 passing through the bracket body 88.1 to a position in which it is proud of the bracket body 88.1. Moreover, by adjusting the length of the threaded bolt 96, at least part of the load of the pod unit 80 can be shifted to the deck unit 16 and the associated level of the building structure. In other words, the pod unit 80 is not only supported by resting on the ground, but also hangs at least partially from the deck unit 16.

Figure 37:
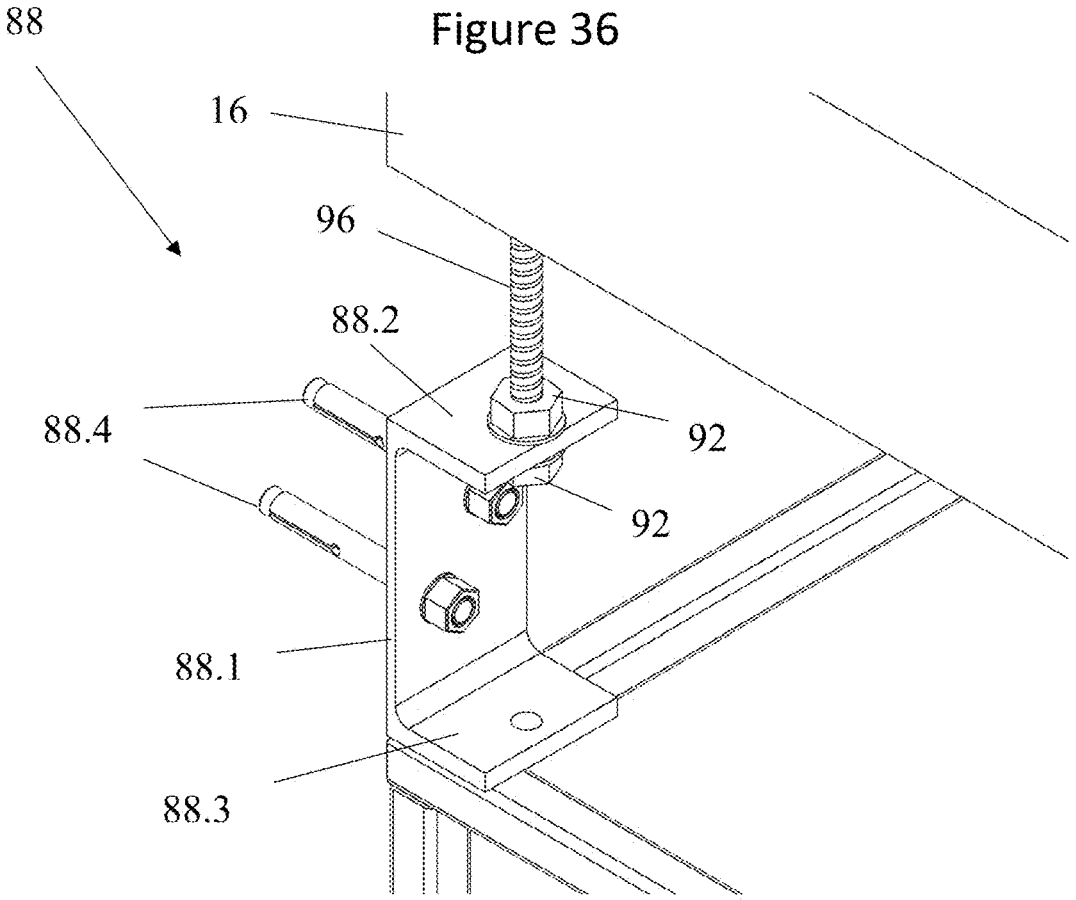
FIG. 37 shows a 3-D view of a suspension and leveling bracket of the pod unit of FIG. 36.

As shown in FIGS. 37 and 38, the adjustment connector further comprises one or more wall anchors 88.4 for an attachment to a wall panel (not shown).

An aspect of the invention further relates to a method of installing and levelling a prefabricated pod according to an embodiment of the invention, by providing a pod unit 80, attaching the pod unit 80 to a unit of a building structure, such as a deck unit 16, and adjusting the height and level of the pod unit 80 relative to the deck unit 16 using the adjustment connectors 88.

Embodiments of the invention relate to a building system including complementarily inter-engaging column unit, beam unit, deck unit, and pod unit, as described herein. The method further extends to a method of constructing a multistory building structure using the building system, assembly, and units.

In one particular example, the method of constructing a multistorey building includes the steps of, on a building site, providing at least two prefabricated column units 12, interlocking the one or more engagement formations 52 of at least one prefabricated beam unit 14 with one or more engagement formations 18 of the column unit 12, and providing at least one deck unit 16 and locking or attaching the deck unit 16 securely to the beam unit 14 and/or column unit 12 using one or more connecting (starter) rods 22.

The Applicant is of the belief that at least an embodiment of the building system and the elements thereof provides several advantages. For example, it is an easy and simple assembly process, all components are fully manufactured off site, are brought to site and assembled, eliminating most on-site waste, thereby turning the construction site into a mere assembly site. The building system according to an embodiment of the invention also vastly reduces construction time, as there is no waiting for a wet conventional concrete column unit or deck unit/floor to cure, and no waiting for formwork to be installed or removed, The building system may enable a simple and effective assembly method for multistorey units, and may remove or at least reduce the quality control on-site to a more easily and controlled environment off-site in a casting fabrication warehouse. This, in turn, may lead to a reduction in tool and equipment requirements on-site, as components can be pre-cast off-site in a casting yard where equipment is stored.

In one specific example, various building units, such as column, beam and deck units 12, 14, 16 are delivered to site according to an assembly schedule, lifted and placed into position and then secured using mechanical fasteners, fastenable by hand or using light manual tools or, if desired, power tools.

As described with reference to FIGS. 10A-10D, the precast column units 12 are equipped with grout tubes 20 that are installed into the reinforcing framework 12.1. The grout tubes 20 are sealed with a shallow plastic plug (not shown) to prevent composite material, typically 50 mPa concrete (or cement) from entering. Once the precast column 12 has been poured, the column units 12 are delivered to site. Advantageously, the column units 12 may be in the form of a pre-cast unit that is 1, 2, 3 or 4 stories high and therefore also possesses structural engagement connectors 18 commensurate with the desired number of stories. During the assembly stage of the units, the grout tubes 20 are unplugged and thus allow for the placement and fixing of one or more column units 12 on top of each other in a longitudinally extending fashion. This is accomplished by delivering a charge of high strength grout in combination with reinforcement bars into each grout tube as described above. The column units 12 therefore offer a quick and simple installation and can be connected for multiple storeys.

The method may include the step of fastening a flange to one or both of the bracket connector plates provided on the column unit 12. The flanges are secured at a height commensurate with the intended depth of the deck units 16, such that it may serve to support a section of a deck unit 16 that protrudes past the beam unit 14 at a level commensurate with the level of the deck unit 16 defined by the depth of the supporting flange 48 on the sidewall of the beam unit 14.

The method may include the further step of providing at least one, but typically a plurality of deck units 16, which are placed perpendicularly to the beam unit 14. In other words, the ends of the deck units 16 rest on the bottom flanges 48 provided on the sidewalls of the beam units 14. Once placed, the deck unit 16 can be loaded immediately. A starter bar 22 is provided on the deck unit 16 is aligned within the voids 16.3 formed in the ends of the deck unit 16, and screwed into the beam unit 14. The method may include the further step of providing additional reinforcement bars that are inserted into the beam unit 14 and the deck unit 16 to increase strength and maintain continuity throughout the structure. The method may include the final step of grouting any of the units or interfaces where the units meet, if desired.

A further aspect of the invention relates to a building structure assembled using the building system and/or one or more prefabricated column units, beam units, deck units, or pod units of embodiments of the invention.

The prefabricated deck unit requires only one labourer to install, the reinforcing mesh does not need to be secured via welding and instead it is connected using a system of locks. This results in less skilled labour costs and manufacturing time. The spheroidal void former consists of a unique design geometry that enables the composite material/concrete to grip on, and it also allows easy transportation of the spheroidal void formers. The deck unit is designed not to require welding to lock in the top and bottom reinforcing mesh, which also serves to prevent damage to the spheroidal void formers commonly encountered during welding. Also, no welding is required to lock in the top and bottom reinforcing mesh units. The pre-cast/prefabricated beam unit is a highly sophisticated structural member that is fully prefabricated off-site and utilises mechanical locking to assemble and install on-site efficiently and without the need for welding or wet trades. The beam unit is secured to the column unit by the end brackets mounted on each end of the beam unit. The beam unit uses a series of couplers and starter bars—these assist in forming continuity through one side to another. The beam unit also allows for the compatibility of alternative prefabricated flooring systems. The height of the beam unit is significantly low which eliminates the wasted space below the floor.

Continuity is maintained—the continuity is maintained throughout the beam unit by the use of the couplers and starter bars.

The beam unit and deck units also provide minimum overall height, which reduces the wasted space below the floor, as no large bulk heads are required to cover the beam units.

The column unit of the invention is a prefabricated precast column unit that is completely manufactured off-site, quality checked off-site, delivered on site, and assembled. Assembly can be done by unskilled labour. The column unit can be manufactured up to 4 stories tall (12 m) and can be joined to further column units using the grouting tubes to extend the height of the intended building structure. The column unit contains mechanical brackets that are cast into the column unit to allow for simple site assembly of connecting beam units. The simplicity of the column unit and the building system of the invention means that a four-storey column unit can be installed in a single lift.

Throughout this specification, unless the context requires otherwise, the word "comprise" or variations such as "comprises" or "comprising", will be understood to imply the inclusion of a stated integer or group of integers but not the exclusion of any other integer or group of integers.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

It is to be appreciated that reference to "one example" or "an example" of the invention is not made in an exclusive sense. Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise.

It is to be understood that the terminology employed above is for the purpose of description and should not be regarded as limiting. The described embodiment is intended to be illustrative of the invention, without limiting the scope thereof. The invention is capable of being practised with various modifications and additions as will readily occur to those skilled in the art.

Various substantially and specifically practical and useful exemplary embodiments of the claimed subject matter are described herein, textually and/or graphically, including the best mode, if any, known to the inventors for carrying out the claimed subject matter. Variations (e.g. modifications and/or enhancements) of one or more embodiments described herein might become apparent to those of ordinary skill in the art upon reading this application.

The inventor(s) expects skilled artisans to employ such variations as appropriate, and the inventor(s) intends for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

The use of words that indicate orientation or direction of travel is not to be considered limiting. Thus, words such as "front", "back", "rear", "side", "up", down⇆, "upper", "lower", "top", "bottom", "forwards", "backwards", "towards", "distal", "proximal", "in", "out" and synonyms, antonyms and derivatives thereof have been selected for convenience only, unless the context indicates otherwise. The inventor(s) envisage that various exemplary embodiments of the claimed subject matter can be supplied in any particular orientation and the claimed subject matter is intended to include such orientations.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Moreover, when any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub-range defined by such separate values is incorporated into the specification as if it were individually recited herein. For example, if a range of 1 to 10 is described, that range includes all values there between, such as for example, 1.1, 2.5, 3.335, 5, 6.179, 8.9999, etc., and includes all sub-ranges there between, such as for example, 1 to 3.65, 2.8 to 8.14, 1.93 to 9, etc.

Accordingly, every portion (e.g., title, field, background, summary, description, abstract, drawing figure, etc.) of this application, other than the claims themselves, is to be regarded as illustrative in nature, and not as restrictive; and the scope of subject matter protected by any patent that issues based on this application is defined only by the claims of that patent.

The invention claimed is:

1. A prefabricated deck unit for a building system, the deck unit including:

a composite material;

a reinforcing framework encased in the composite material, the reinforcing framework comprising:

a first metal mesh unit, a plurality of spheroidal void formers attached to or in intimate contact with the first mesh unit, the plurality of spheroidal void formers being interspaced to define spaces between the void formers filled with a portion of the composite material; and a second mesh unit resting upon, or attached to, the spheroidal void formers, wherein the framework defines at least one terminal channel on at least one end of the deck unit, the terminal channel being shaped and dimensioned to snugly receive an elongate connecting rod for connecting the deck unit to a further structural element of the building system, wherein each spheroidal void former comprises at least two connectors for connecting the spheroidal void former to the first and second mesh units, wherein a body of each spheroidal void former comprises a cinched waist defining a radially extending interstitial gap that in turn defines an operatively lower lip as a circumferentially extending seat for receiving a portion of the composite material, and wherein the spaces between the plurality of void formers and the gap defined by the cinched waist in each void former are configured such that the composite material within said spaces and gaps forms a truss structure of composite material in the prefabricated deck unit thereby enabling the prefabricated deck unit to be transportable as an integrated building structure.

2. The prefabricated deck unit of claim 1, wherein the at least two connectors are integrally formed with the spheroidal body of the spheroidal void former.

3. The prefabricated deck unit of claim 1, wherein each spheroidal void former comprises an indented crown.

4. The prefabricated deck unit of claim 1, wherein each spheroidal void former comprises two body halves arranged in a bisected mirror-fashion.

5. The prefabricated deck unit of claim 1, comprising a plurality of spacer chairs, wherein the plurality of spacer chairs are arranged such that at least one of the first and second mesh units can be elevated from a surface.

6. The prefabricated deck unit of claim 1, comprising a plurality of ferrules attached to the reinforcing framework, the plurality of ferrules being configured to attach to respective magnets.

7. The prefabricated deck unit of claim 1, wherein at least one sidewall of the prefabricated deck unit is tapered such that when two prefabricated deck units are positioned next to one another, a recess between the two deck units is formed.

8. The prefabricated deck unit of claim 7, wherein the at least one sidewall comprises one or more grooves.

9. A method of making a prefabricated deck unit, the method comprising:

providing a formwork mould;

positioning a first reinforcing mesh unit within the formwork mould;

positioning a plurality of spheroidal void formers on the first reinforcing mesh unit such that spaces are defined between each of the void formers, a body of each spheroidal void former comprising a cinched waist defining a radially extending interstitial gap that in turn defines an operatively lower lip as a circumferentially extending seat;

positioning a second reinforcing mesh unit such that the second reinforcing mesh unit rests on or is attached to the plurality of spheroidal void formers; and pouring a composite material into the formwork mould comprising the first and second reinforcing mesh units and the plurality of spheroidal void formers such that a portion of the composite material is received within the spaces defined between the plurality of void formers and the interstitial gap defined by the cinched waist of the void formers, curing the composite material in the mould to form the prefabricated deck unit that is transportable as an integrated building structure; wherein the method is performed such that the composite material within the spaces defined between the plurality of void formers and the gaps forms a truss structure of composite material in the prefabricated deck unit.

10. The method of claim 9, comprising attaching a plurality of ferrules to the first reinforcing mesh unit, wherein the plurality of ferrules are configured to attach to respective magnets for holding the first reinforcing mesh unit to the formwork mould.

11. The method of claim 9, wherein the composite material is inserted into the formwork mould from a substantially central position relative to the deck unit.

12. A building structure comprising a plurality of prefabricated deck units of claim 1.

13. A method of installing a prefabricated deck unit of claim 1, the method comprising:

positioning at least one elongate connecting rod within the at least one terminal channel of the prefabricated deck unit; and connecting the at least one connecting rod to a further structural element of the building system.

14. The method of claim 13, comprising inserting a composite material in gaps between the at least one connecting rod and the terminal channel.

* * * * *